US009396675B2

(12) United States Patent
Kim et al.

(10) Patent No.: US 9,396,675 B2
(45) Date of Patent: Jul. 19, 2016

(54) METHOD FOR SENSING DEGRADATION OF ORGANIC LIGHT EMITTING DISPLAY

(71) Applicant: LG Display Co., Ltd., Seoul (KR)

(72) Inventors: Changhee Kim, Daegu (KR); Kilhwan Oh, Seoul (KR); Hunki Shin, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 92 days.

(21) Appl. No.: 14/584,071

(22) Filed: Dec. 29, 2014

(65) Prior Publication Data

US 2016/0071445 A1 Mar. 10, 2016

(30) Foreign Application Priority Data

Sep. 5, 2014 (KR) ..... 10-2014-0119357

(51) Int. Cl.
*G09G 3/00* (2006.01)
*G09G 3/32* (2016.01)

(52) U.S. Cl.
CPC ..... *G09G 3/006* (2013.01); *G09G 3/3225* (2013.01); *G09G 3/3291* (2013.01); *G09G 2300/0814* (2013.01); *G09G 2300/0842* (2013.01); *G09G 2320/043* (2013.01); *G09G 2330/12* (2013.01)

(58) Field of Classification Search
CPC ... G09G 3/006; G09G 3/3225; G09G 3/3233; G09G 3/3241; G09G 3/3258; G09G 3/3291; G09G 2300/0814; G09G 2300/0819; G09G 2300/0842; G09G 2320/043; G09G 2320/045; G09G 2320/0233; G09G 2330/12
USPC ..... 345/212
See application file for complete search history.

(56) References Cited

U.S. PATENT DOCUMENTS

| | | | | |
|---|---|---|---|---|
| 7,834,556 | B2 * | 11/2010 | Yamamoto | G09G 3/3233 315/169.1 |
| 8,525,758 | B2 * | 9/2013 | Sugimoto | G09G 5/001 313/463 |
| 9,125,249 | B2 * | 9/2015 | Kim | G09G 3/2048 |
| 2008/0150846 | A1 * | 6/2008 | Chung | G09G 3/3233 345/80 |
| 2008/0224965 | A1 * | 9/2008 | Kim | G09G 3/3233 345/76 |
| 2009/0027310 | A1 * | 1/2009 | Kim | G09G 3/3233 345/76 |

(Continued)

FOREIGN PATENT DOCUMENTS

| | | | |
|---|---|---|---|
| KR | 10-2013-0024744 | A | 3/2013 |
| KR | 10-2013-0053660 | A | 5/2013 |

OTHER PUBLICATIONS

Korean Office Action, Korean Application No. 10-2014-0119357, Jun. 20, 2015, 5 pages (with concise explanation of relevance).

*Primary Examiner* — Tom Sheng
(74) *Attorney, Agent, or Firm* — Fenwick & West LLP

(57) ABSTRACT

A method for sensing degradation of an organic light emitting display includes an initialization step for applying a sensing data voltage to a gate node of a driving TFT and applying an initialization voltage to a source node of the driving TFT, a boosting step for floating the gate node and the source node of the driving TFT and applying a drain-to-source current of the driving TFT to an organic element, a sensing step for again applying the initialization voltage to the source node of the driving TFT, setting a gate-to-source voltage of the driving TFT depending on a degradation degree of the organic element, and storing the drain-to-source current of the driving TFT determined by the set gate-to-source voltage in a line capacitor, and a sampling step for outputting a voltage stored in the line capacitor as a sensing voltage.

20 Claims, 24 Drawing Sheets

(56) References Cited

U.S. PATENT DOCUMENTS

2009/0051628 A1* 2/2009 Kwon ..... G09G 3/3233 345/77
2010/0321422 A1* 12/2010 Ishiguro ..... G09G 3/3233 345/698
2011/0122119 A1* 5/2011 Bae ..... G09G 3/3233 345/211
2011/0193855 A1* 8/2011 Han ..... G09G 3/3233 345/214
2011/0227505 A1* 9/2011 Park ..... H05B 33/0896 315/297
2011/0285691 A1* 11/2011 Takasugi ..... G09G 3/3233 345/212
2013/0141316 A1* 6/2013 Lee ..... G09G 3/3266 345/76
2013/0162617 A1* 6/2013 Yoon ..... G09G 3/3291 345/211
2014/0062331 A1* 3/2014 Nam ..... G09G 3/3233 315/226
2015/0138253 A1* 5/2015 Kimura ..... G09G 3/3266 345/690
2015/0294623 A1* 10/2015 Toyomura ..... G09G 3/3233 345/212

* cited by examiner

<Tint>

<Tbst>

<Tsen>

<Tsam>

<Tint>

<Tbst>

<Twrt>

<Tsen>

METHOD FOR SENSING DEGRADATION OF ORGANIC LIGHT EMITTING DISPLAY

CROSS-REFERENCE TO RELATED APPLICATION

This application claims the benefit of Korea Patent Application No. 10-2014-0119357 filed on Sep. 05, 2014, which is incorporated herein by reference for all purposes as if fully set forth herein.

BACKGROUND OF THE INVENTION

1. Field of the Invention

Embodiments of the invention relate to an organic light emitting display and more particularly to a method for sensing degradation of an organic element of an organic light emitting display.

2. Discussion of the Related Art

An active matrix organic light emitting display includes an organic light emitting diode (hereinafter, referred to as "organic element") capable of emitting light by itself and has advantages of a fast response time, a high light emitting efficiency, a high luminance, a wide viewing angle, and the like.

The organic element serving as a self-emitting element includes an anode electrode, a cathode electrode, and an organic compound layer formed between the anode electrode and the cathode electrode. The organic compound layer includes a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML and form excitons. As a result, the emission layer EML generates visible light.

The organic light emitting display arranges subpixels including the organic element in a matrix form and adjusts a luminance of the subpixels depending on grayscale of video data. Each subpixel includes a driving thin film transistor (TFT), which controls a driving current flowing in the organic element depending on a gate-to-source voltage Vgs between a gate electrode and a source electrode of the driving TFT. A display grayscale (i.e., a display luminance) is adjusted by a light emission amount of the organic element that is proportional to a magnitude of the driving current.

The organic element generally has a degradation characteristic of an increase in an operating point voltage (i.e., a threshold voltage) of the organic element and a reduction in an emission efficiency as an emission time of the organic element passes. Because an accumulated value of currents applied to the organic element of each subpixel is proportional to an accumulated value of gray levels represented in each subpixel, the organic elements of the subpixels may have different degradation degrees. A degradation deviation between the organic elements of the subpixels results in a luminance deviation, and an image sticking phenomenon may be generated by an increase in the luminance deviation.

A related art compensation method for sensing the degradation of the organic element and modulating video data based on a sensing value using an external circuit is known to compensate for the degradation deviation of the organic element. The related art compensation method connects a current source to each subpixel through a sensing line and applies a sensing current from the current source to the organic element. Then, the related art compensation method decides a degradation degree of the organic element based on an anode voltage of the organic element sensed through the sensing line.

However, the related art compensation method has the following problems.

Firstly, the sensing current applied to each organic element has to be uniformly set, so as to accurately sense the degradation of the organic element. For this, the current sources have to be respectively connected to the sensing lines. In this instance, because the number of necessary current sources increases, the manufacturing cost and a circuit design area of the organic light emitting display increase. Furthermore, it is very difficult to uniformly set the sensing currents applied from all of the current sources, and thus it is very difficult to increase the sensing accuracy.

Secondly, the sensing lines may be formed by an independent sensing line structure or a shared sensing line structure depending on a connection structure.

In the independent sensing line structure, the plurality of subpixels disposed on the same horizontal line may be respectively connected to the plurality of sensing lines. Hence, the organic elements may be individually operated, and the degradation degree of each organic element may be directly sensed. However, because one sensing line is assigned to each subpixel, an aperture ratio decreases. Hence, a current density of the organic element increases during when driving the organic element. As a result, a degradation speed of the organic element in the related art organic light emitting display having the independent sensing line structure increases, and life span of the related art organic light emitting display decreases.

In the shared sensing line structure, a plurality of unit pixels disposed on the same horizontal line may be respectively connected to the plurality of sensing lines, and subpixels constituting each unit pixel may share the same sensing line with one another. In the related art organic light emitting display having the shared sensing line structure, because the organic elements cannot individually operate during the degradation sensing (namely, because the organic elements of each unit pixel simultaneously operate), the degradation degree of each organic element cannot be accurately sensed.

SUMMARY OF THE INVENTION

Embodiments of the invention provide a method for sensing degradation of an organic light emitting display capable of increasing the sensing accuracy when degradation of an organic element is sensed.

In one aspect, there is a method for sensing degradation of an organic light emitting display including a plurality of subpixels each including an organic element and a driving thin film transistor (TFT) controlling an emission amount of the organic element and a sensing unit connected to at least one of the plurality of subpixels through a sensing line, the method comprising during an initialization period, applying a sensing data voltage to a gate node of the driving TFT and applying an initialization voltage to a source node of the driving TFT to turn on the driving TFT, during a boosting period after the initialization period, floating the gate node and the source node of the driving TFT and applying a drain-to-source current of the driving TFT to the organic element to turn on the organic element, during a sensing period after the boosting period, again applying the initialization voltage to the source node of the driving TFT, the again applying of the initialization voltage setting a gate-to-source voltage of the driving TFT to be indicative of a degradation degree of the organic element, and charging a line capacitor of the sensing line with the drain-to-source current of the driving TFT that is controlled by the set gate-to-source voltage, and during a sampling period after the sending period, outputting a voltage stored in the line capacitor as a sensing voltage.

The method further comprises a writing period between the boosting period and the sensing period. During the writing period, the sensing data voltage is again applied to the gate node of the driving TFT and causes the gate-to-source voltage of the driving TFT to be preset to be indicative of the degradation degree of the organic element.

In one embodiment, a method of operation in an organic light emitting display comprising a subpixel including an organic element and a driving thin film transistor (TFT) controlling current through the organic element is disclosed. The method comprises applying a sensing data voltage to a gate node of the driving TFT and applying an initialization voltage to a source node of the driving TFT to turn on the driving TFT; after applying the sensing data voltage and initialization voltage, floating the gate node and the source node of the driving TFT, a source voltage at the source node increasing to at least a turn-on voltage of the organic element while the gate node and the source node are floated; and after floating the gate node and the source node of the driving TFT, again applying the initialization voltage to the source node of the driving TFT while the gate node is floated, the gate-to-source voltage set to be indicative of a degradation degree of the organic element as a result of again applying the initialization voltage to the source node of the driving TFT.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Configuration of an organic light emitting display, to which a degradation sensing method of the organic light emitting display according to an exemplary embodiment of the invention is applied, is described with reference to FIGS. 1 to 5.

Figure 1:
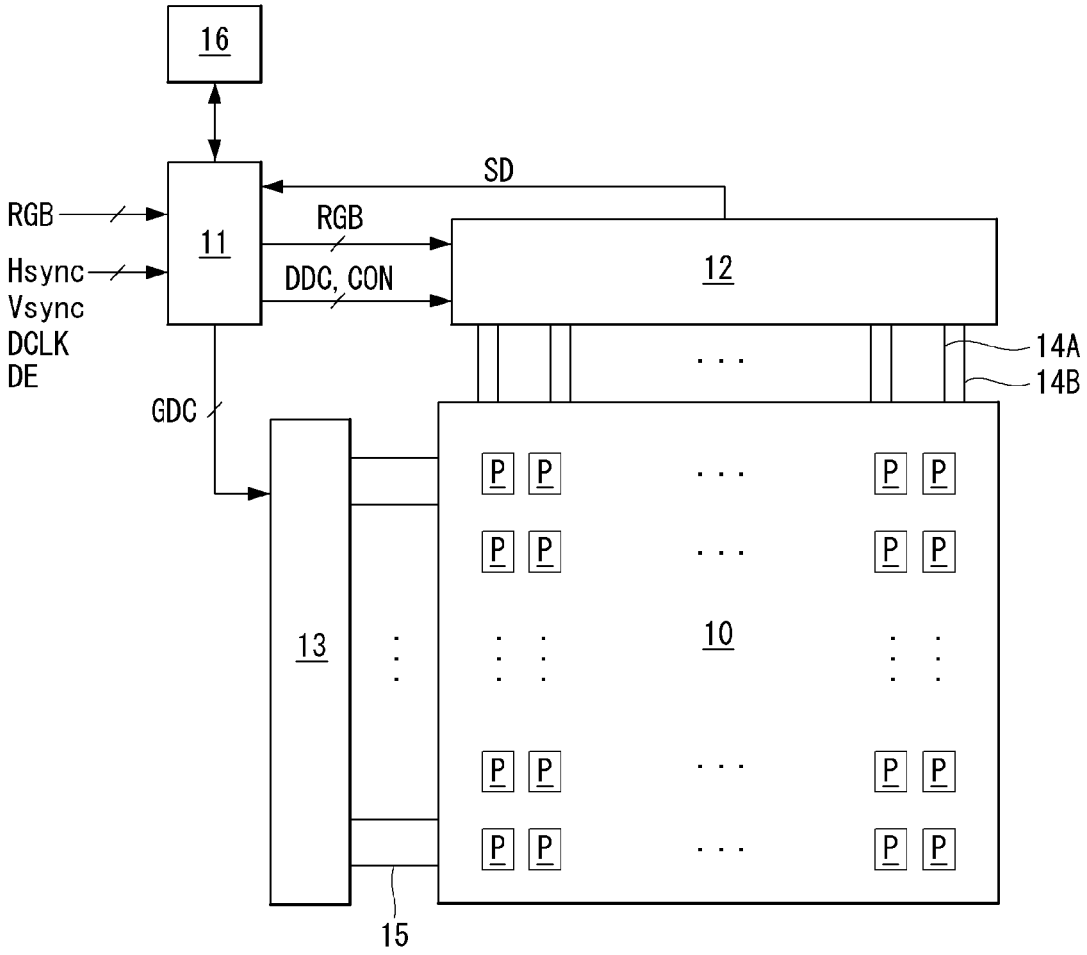
FIG. 1 shows an organic light emitting display according to an exemplary embodiment of the invention.
Figure 2A:
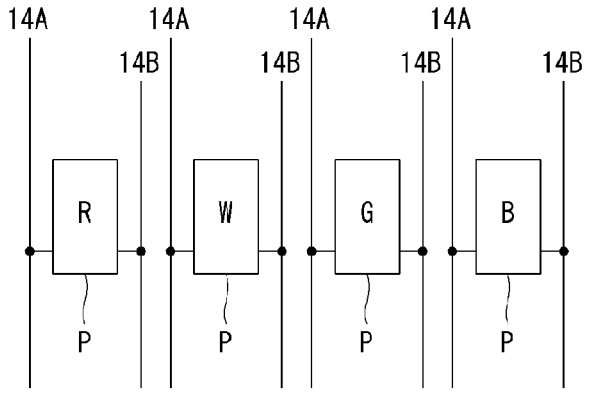
FIGS. 2A and 2B show an example of the connection of sensing lines and subpixels.
Figure 2B:
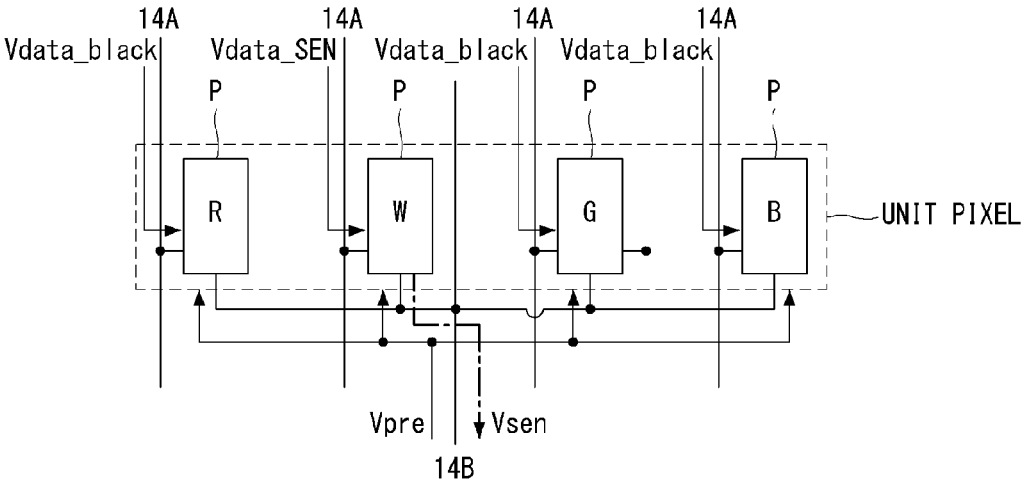
Figure 3:
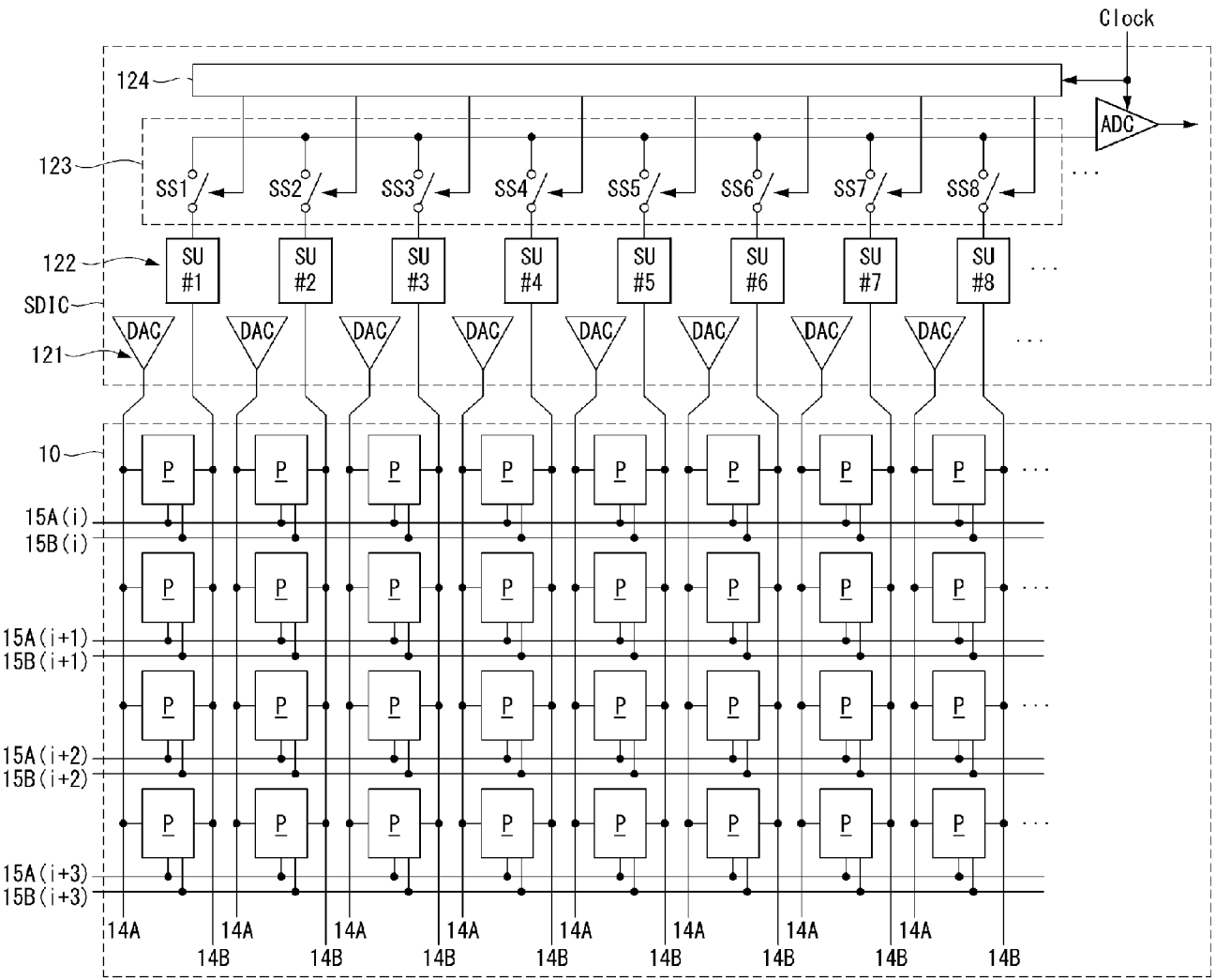
FIGS. 3 and 4 show an example of configuration of a panel array and a data driver integrated circuit (IC)
Figure 4:
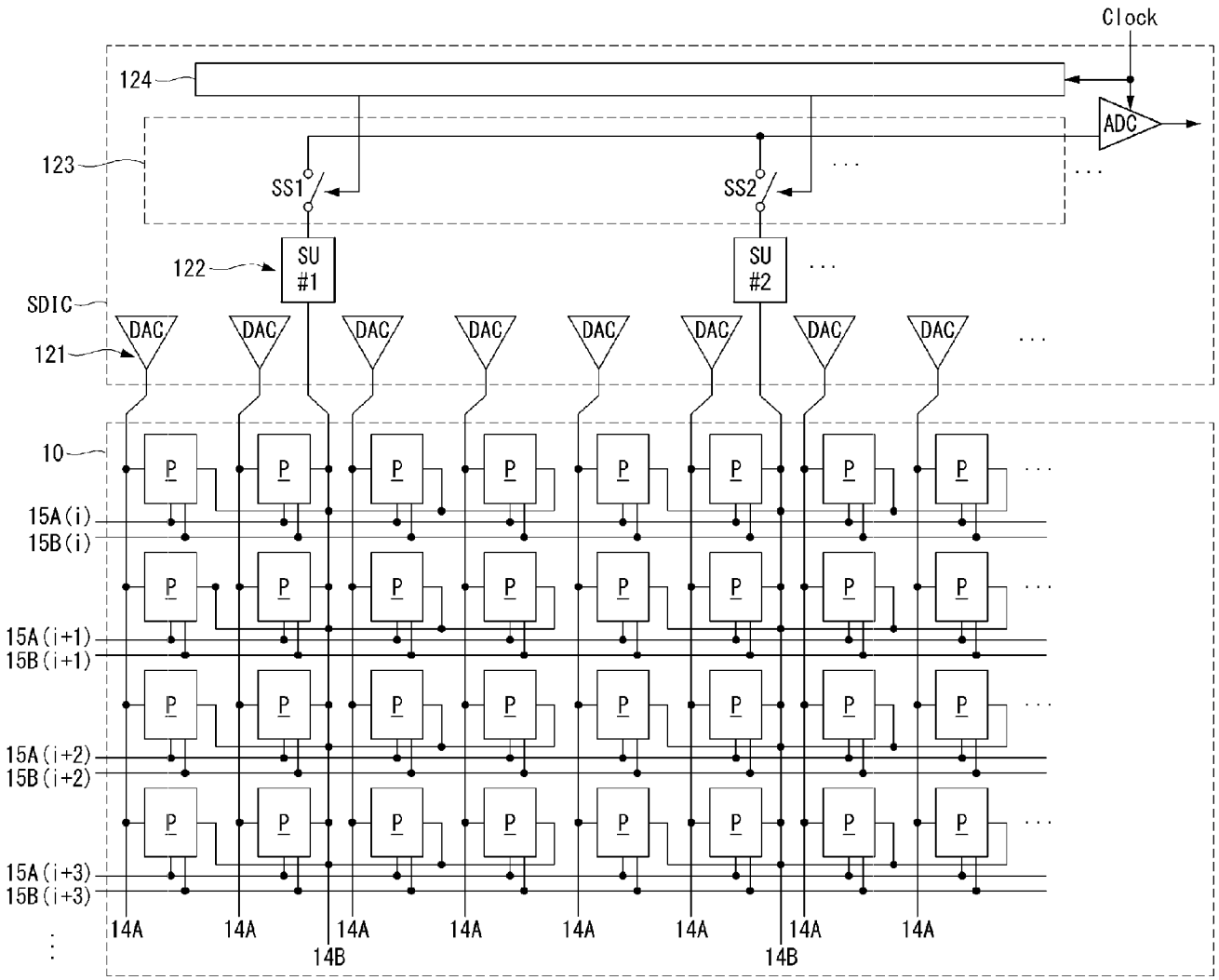

FIG. 1 shows an organic light emitting display according to an exemplary embodiment of the invention. FIGS. 2A and 2B show an example of the connection between sensing lines and subpixels. FIGS. 3 and 4 show an example of a configuration of a panel array and a data driver integrated circuit (IC).

As shown in FIGS. 1 to 4, an organic light emitting display according to the embodiment of the invention may include a display panel 10, a timing controller 11, a data driving circuit 12, a gate driving circuit 13, and a memory 16.

The display panel 10 includes a plurality of data lines 14A, a plurality of sensing lines 14B, a plurality of gate lines 15 crossing the data lines 14A and the sensing lines 14B, and subpixels P respectively arranged at crossings of the data, sensing, and gate lines 14A, 14B, and 15 in a matrix form. The gate lines 15 include a plurality of first gate lines 15A, to which a scan control signal SCAN (refer to FIG. 5) is sequentially supplied, and a plurality of second gate lines 15B, to which a sensing control signal SEN (refer to FIG. 5) is sequentially supplied.

As shown in FIGS. 2A and 2B, the subpixels P may include a red (R) subpixel for red display, a white (W) subpixel for white display, a green (G) subpixel for green display, and a blue (B) subpixel for blue display, which are adjacent to one another in a horizontal direction. Each subpixel P may be connected to one of the plurality of data lines 14A, one of the plurality of sensing lines 14B, one of the plurality of first gate lines 15A, and one of the plurality of second gate lines 15B. Each subpixel P may be electrically connected to the data line 14A in response to the scan control signal SCAN input through the first gate line 15A. Hence, each subpixel P may receive a sensing data voltage Vdata_SEN (or a black level display data voltage Vdata_black) from the data line 14A and may output a sensing signal through the sensing line 14B.

In an independent sensing line structure, as shown in FIGS. 2A and 3, the sensing lines 14B may be respectively connected to the horizontally adjacent subpixels. For example, the horizontally adjacent R, W, G, and B subpixels may be respectively connected to the different sensing lines 14B.

In a shared sensing line structure, as shown in FIGS. 2B and 4, one sensing line 14B may be commonly connected to the plurality of horizontally adjacent subpixels constituting one unit pixel. For example, the horizontally adjacent R, W, G, and B subpixels constituting one unit pixel may share the same sensing line 14B with one another. It is easier for the sensing line sharing structure, in which one sensing line 14B is assigned to each unit pixel, to secure an aperture ratio of the display panel 10 than for the sensing line independent structure.

Each subpixel P receives a high potential driving voltage EVDD and a low potential driving voltage EVSS from a power generator (not shown). Each subpixel P according to the embodiment of the invention may include an organic element, a driving thin film transistor (TFT), first and second switch TFTs, and a storage capacitor for the external compensation. The TFTs constituting the subpixel P may be implemented as a p-type transistor or an n-type transistor. Further, semiconductor layers of the TFTs constituting the subpixel P may contain amorphous silicon, polycrystalline silicon, or oxide.

Each subpixel P may operate differently in a normal drive mode for implementing a display image and a sensing drive mode for obtaining a sensing value. The sensing drive mode may be performed for a predetermined period of time in a power-on process or may be performed in vertical blank periods during the normal drive mode. Further, the sensing drive mode may be performed for a predetermined period of time in a power-off process.

The sensing drive mode may include a first sensing drive mode for sensing a threshold voltage deviation and a mobility deviation of the driving TFT and a second sensing drive mode for sensing degradation of the organic element. The degradation sensing method of the organic light emitting display according to the embodiment of the invention includes only the second sensing drive mode on the assumption that the threshold voltage deviation and the mobility deviation of the driving TFT have already been compensated for.

The sensing drive mode may be configured as one operation of the data driving circuit 12 and the gate driving circuit 13 under the control of the timing controller 11. The timing controller 11 performs an operation for obtaining compensation data for the degradation compensation based on the sensing result and performs an operation for modulating digital video data for the normal drive mode using the compensation data.

The data driving circuit 12 includes at least one data driver integrated circuit (IC) SDIC. The data driver IC SDIC includes a plurality of digital-to-analog converters (DACs) 121 respectively connected to the data lines 14A, a plurality of sensing units 122 (or SU#1 to SU#k) connected to the sensing lines 14B, a multiplexer (MUX) 123 selectively connecting the sensing units 122 to an analog-to-digital converter (ADC), and a shift register 124 which generates a selection control signal and selectively turns on switches SS1 to SSk of the multiplexer 123.

In the normal drive mode, the DACs 121 of the data driver IC SDIC convert digital video data RGB into an image display data voltage in response to a data control signal DDC supplied from the timing controller 11 and supply the image display data voltage to the data lines 14A. In the sensing drive mode, the DACs 121 of the data driver IC SDIC may generate a sensing data voltage Vdata_SEN (or a black level display data voltage Vdata_black) in response to the data control signal DDC supplied from the timing controller 11 and may supply the sensing data voltage Vdata_SEN (or the black level display data voltage Vdata_black) to the data lines 14A.

The sensing units SU#1 to SU#k of the data driver IC SDIC may be respectively connected to the sensing lines 14B. The number of sensing lines 14B and the number of sensing units SU#1 to SU#k in the shared sensing line structure shown in FIG. 4 are less than those in the independent sensing line structure shown in FIG. 3. The embodiment of the invention may adopt the independent sensing line structure. However, it is preferable, but not required, that the embodiment of the invention adopts the shared sensing line structure as it reduces a circuit design area and increases the aperture ratio of the display panel 10.

Because the degradation sensing method of the organic light emitting display according to the embodiment of the invention applies a turn-on current to the organic element using the driving TFT instead of separate current sources, the sensing units SU#1 to SU#k according to the embodiment of the invention do not need to have the current sources used in the related art. Hence, the embodiment of the invention may reduce manufacturing costs and the circuit design area. Further, because the embodiment of the invention may adopt a voltage setting method, which is able to be more easily controlled than a current setting method, the sensing accuracy may increase.

As described in this specification, the degradation sensing method of the organic light emitting display according to the embodiment of the invention adopts the voltage setting method. Therefore, even if the shared sensing line structure is adopted, the subpixels can be individually controlled and degradation of an organic element of a desired subpixel can be accurately sensed. For example, as shown in FIG. 2B, if the embodiment of the invention wants to sense degradation of the organic element of the W subpixel among the R, W, G, and B subpixels sharing the sensing line 14B with one another, an initialization voltage Vpre may be simultaneously applied to all of the R, W, G, and B subpixels, a sufficient voltage (i.e., the sensing data voltage Vdata_SEN) capable of turning on only the organic element of the W subpixel may be applied to the W subpixel, and the black level display data voltage Vdata_black, which is not sufficient to cause light emission from the organic elements of the remaining R, G, and B subpixels, may be applied to the remaining R, G, and B subpixels.

The ADC of the data driver IC SDIC converts a sensing voltage input through the multiplexer 123 into a digital sensing value SD and transmits the digital sensing value SD to the timing controller 11.

In the sensing drive mode, the gate driving circuit 13 generates a scan control signal based on a gate control signal GDC and then may supply the scan control signal to the first gate lines 15A line by line in sequential manner. In the sensing drive mode, the gate driving circuit 13 generates a sensing control signal based on the gate control signal GDC and then may supply the sensing control signal to the second gate lines 15B line by line in sequential manner.

The timing controller 11 generates the data control signal DDC for controlling operation timing of the data driving circuit 12 and the gate control signal GDC for controlling operation timing of the gate driving circuit 13 based on timing signals, such as a vertical sync signal Vsync, a horizontal sync signal Hsync, a data enable signal DE, and a dot clock DCLK. The timing controller 11 may separate the normal drive mode from the sensing drive mode based on a predetermined reference signal (for example, a driving power enable signal, the vertical sync signal Vsync, the data enable signal DE, etc.) and may generate the data control signal DDC and the gate control signal GDC in conformity with the normal drive mode and the sensing drive mode. Further, the timing controller 11 may further generate related switching control signals CON (including signals PRE and SAM of FIG. 5), so as to operate internal switches of the sensing units SU#1 to SU#k in conformity with the normal drive mode and the sensing drive mode.

In the sensing drive mode, the timing controller 11 may transmit digital data corresponding to the sensing data voltage Vdata_SEN to the data driving circuit 12. In the embodiment disclosed herein, it is preferable, but not required, that the sensing data voltage Vdata_SEN applied to each subpixel is set differently depending on an amount of the threshold voltage deviation and an amount of the mobility deviation of the driving TFT included in the corresponding subpixel. Because the embodiment of the invention sets the sensing data voltage Vdata_SEN to be applied to the corresponding subpixel after previously considering the amount of the threshold voltage deviation and the amount of the mobility deviation of the driving TFT included in the corresponding subpixel, the embodiment of the invention may greatly suppress a distortion of the sensing data voltage Vdata_SEN resulting from the deviation amounts. Hence, the sensing accuracy may further increase.

In the sensing drive mode, the timing controller 11 may calculate compensation data capable of compensating for the degradation of the organic element of each subpixel P based on the digital sensing value SD transmitted from the data driving circuit 12 and may store the compensation data in the memory 16. In the normal drive mode, the timing controller 11 may modulate the digital video data RGB for the image display based on the compensation data stored in the memory 16 and then may transmit the modulated digital video data RGB to the data driving circuit 12.

Figure 5:
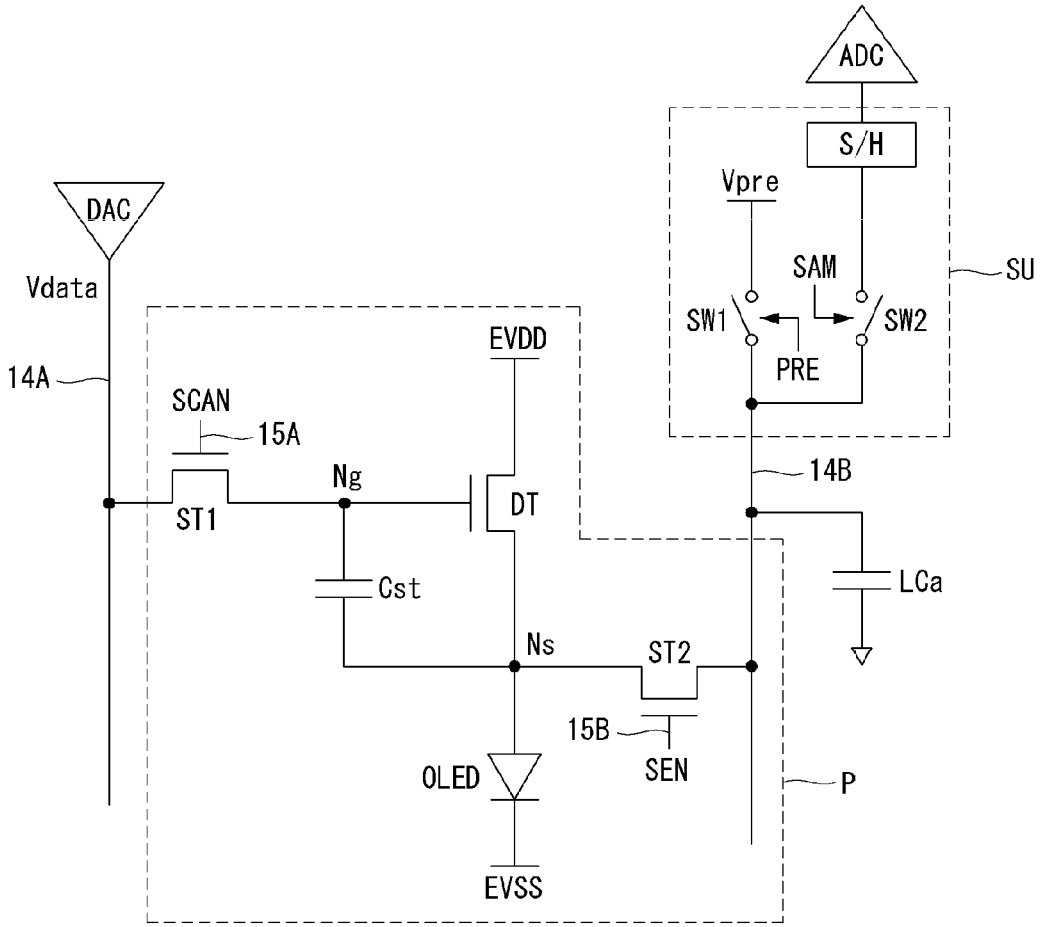
FIG. 5 shows an example of configuration of a subpixel, to which a degradation sensing method according to an exemplary embodiment of the invention is applied, and a sensing unit.

FIG. 5 shows an example configuration of a subpixel, to which the degradation sensing method according to the embodiment of the invention is applied, and a sensing unit. Since the configuration shown in FIG. 5 is a mere example, the embodiment of the invention is not limited thereto.

As shown in FIG. 5, each subpixel P may include an organic element OLED, a driving TFT DT, a storage capacitor Cst, a first switch TFT ST1, and a second switch TFT ST2.

The organic element OLED includes an anode electrode connected to a source node Ns, a cathode electrode connected to an input terminal of the low potential driving voltage EVSS, and an organic compound layer positioned between the anode electrode and the cathode electrode.

The driving TFT DT controls an amount of a current input to the organic element OLED depending on a gate-to-source voltage Vgs of the driving TFT DT. The driving TFT DT includes a gate electrode connected to a gate node Ng, a drain electrode connected to an input terminal of the high potential driving voltage EVDD, and a source electrode connected to the source node Ns. The storage capacitor Cst is connected between the gate node Ng and the source node Ns. The first switch TFT ST1 applies a data voltage Vdata (including the sensing data voltage Vdata_SEN or the black level display data voltage Vdata_black) on the data line 14A to the gate node Ng in response to the scan control signal SCAN. The first switch TFT ST1 includes a gate electrode connected to the first gate line 15A, a drain electrode connected to the data line 14A, and a source electrode connected to the gate node Ng. The second switch TFT ST2 turns on the flow of a current between the source node Ns and the sensing line 14B in response to the sensing control signal SEN. The second switch TFT ST2 includes a gate electrode connected to the second gate line 15B, a drain electrode connected to the sensing line 14B, and a source electrode connected to the source node Ns.

Each sensing unit SU may include an initialization switch SW1, a sampling switch SW2, and a sample and hold unit S/H.

The initialization switch SW1 is turned on in response to an initialization control signal PRE and turns on the flow of a current between an input terminal of the initialization voltage Vpre and the sensing line 14B. The sampling switch SW2 is turned on in response to a sampling control signal SAM and connects the sensing line 14B to the sample and hold unit S/H. When the sampling switch SW2 is turned on, the sample and hold unit S/H samples and holds a voltage (as the sensing voltage) stored in a line capacitor LCa of the sensing line 14B and then transmits the voltage to the ADC. In the embodiment disclosed herein, the line capacitor LCa may be replaced by a parasitic capacitor existing in the sensing line 14B.

Hereinafter, a method for sensing the degradation of the organic light emitting display according to the embodiment of the invention is described in detail based on the above-described configuration of the organic light emitting display.

Figure 6:
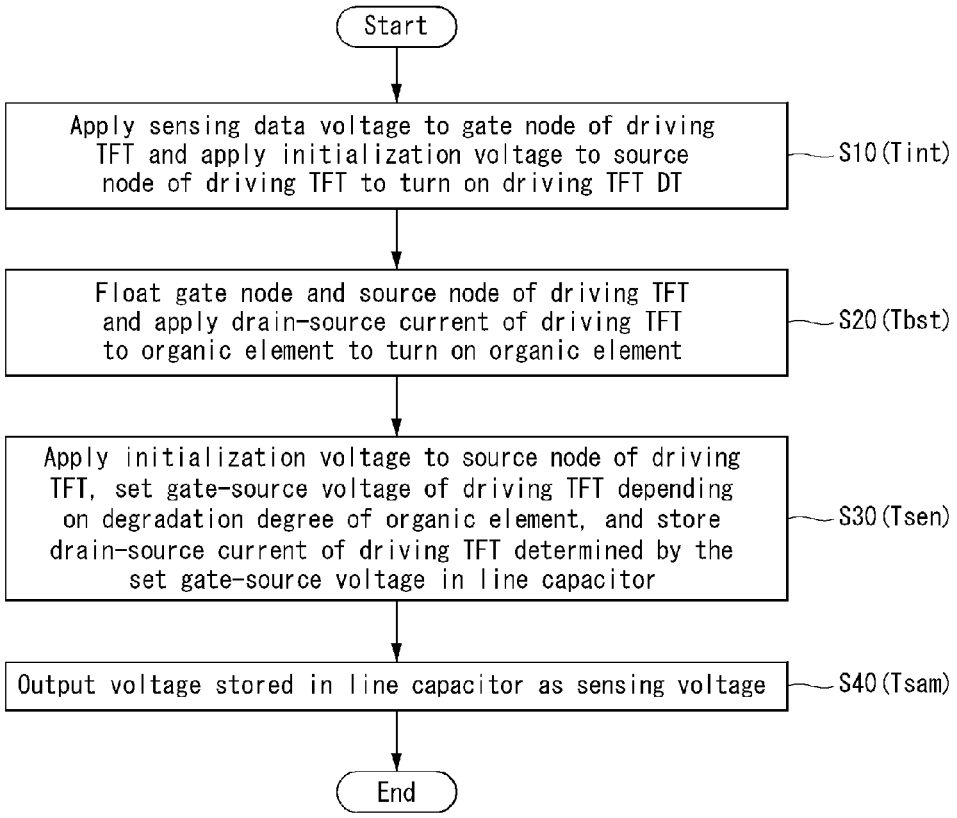
FIG. 6 shows a method for sensing degradation of an organic light emitting display according to an exemplary embodiment of the invention.

FIG. 6 shows a method for sensing degradation of the organic light emitting display according to the embodiment of the invention.

As shown in FIG. 6, the degradation sensing method according to the embodiment of the invention includes an initialization step S10, a boosting step S20, a sensing step S30, and a sampling step S40.

In the initialization step S10, the degradation sensing method according to the embodiment of the invention applies the sensing data voltage Vdata_SEN to the gate node Ng of the driving TFT DT and applies the initialization voltage Vpre to the source node Ns of the driving TFT DT, thereby turning on the driving TFT DT.

When a plurality of subpixels constituting the same unit pixel share one sensing line 14B with one another as shown in FIG. 2B, in the initialization step S10, the degradation sensing method according to the embodiment of the invention applies the sensing data voltage Vdata_SEN only to the gate node Ng of the driving TFT DT of a sensing target subpixel among the plurality of subpixels constituting the same unit pixel and applies the black level display data voltage Vdata_black, which is less than the sensing data voltage Vdata_SEN, to the gates nodes Ng of the driving TFTs DT of remaining subpixels excluding the sensing target subpixel from the plurality of subpixels, thereby efficiently selecting only the sensing target subpixel. Unlike the sensing target subpixel, to which the sensing data voltage Vdata_SEN is applied, the driving TFTs DT of the non-sensing target subpixels, to which the black level display data voltage Vdata_black is applied, do not need to be turned on. For this, it is preferable, but not required, that a difference between the black level display data voltage Vdata_black and the initialization voltage Vpre is set to be less than a threshold voltage of the driving TFT DT. Further, because the initialization voltage Vpre is commonly applied to all of the subpixels of the same unit pixel, it is preferable, but not required, that the initialization voltage Vpre is set to be less than a turn-on voltage (i.e., an operating point voltage) of the organic element OLED, so as to prevent the unnecessary turn-on operation of the non-sensing target subpixels.

In the boosting step S20, the degradation sensing method according to the embodiment of the invention floats the gate node Ng and the source node Ns of the driving TFT DT and applies a drain-to-source current Ids of the driving TFT DT to the organic element OLED, thereby turning on the organic element OLED.

In the sensing step S30, the degradation sensing method according to the embodiment of the invention again applies the initialization voltage Vpre to the source node Ns of the driving TFT DT, which sets the gate-to-source voltage Vgs of the driving TFT DT depending on a degradation degree of the organic element OLED, and stores the drain-to-source current Ids of the driving TFT DT in the line capacitor LCa of the sensing line 14B. The level of the drain-to-source current Ids is controlled by the set gate-to-source voltage Vgs.

In the sampling step S40, the degradation sensing method according to the embodiment of the invention outputs a voltage stored in the line capacitor LCa as a sensing voltage Vsen.

Figure 7:
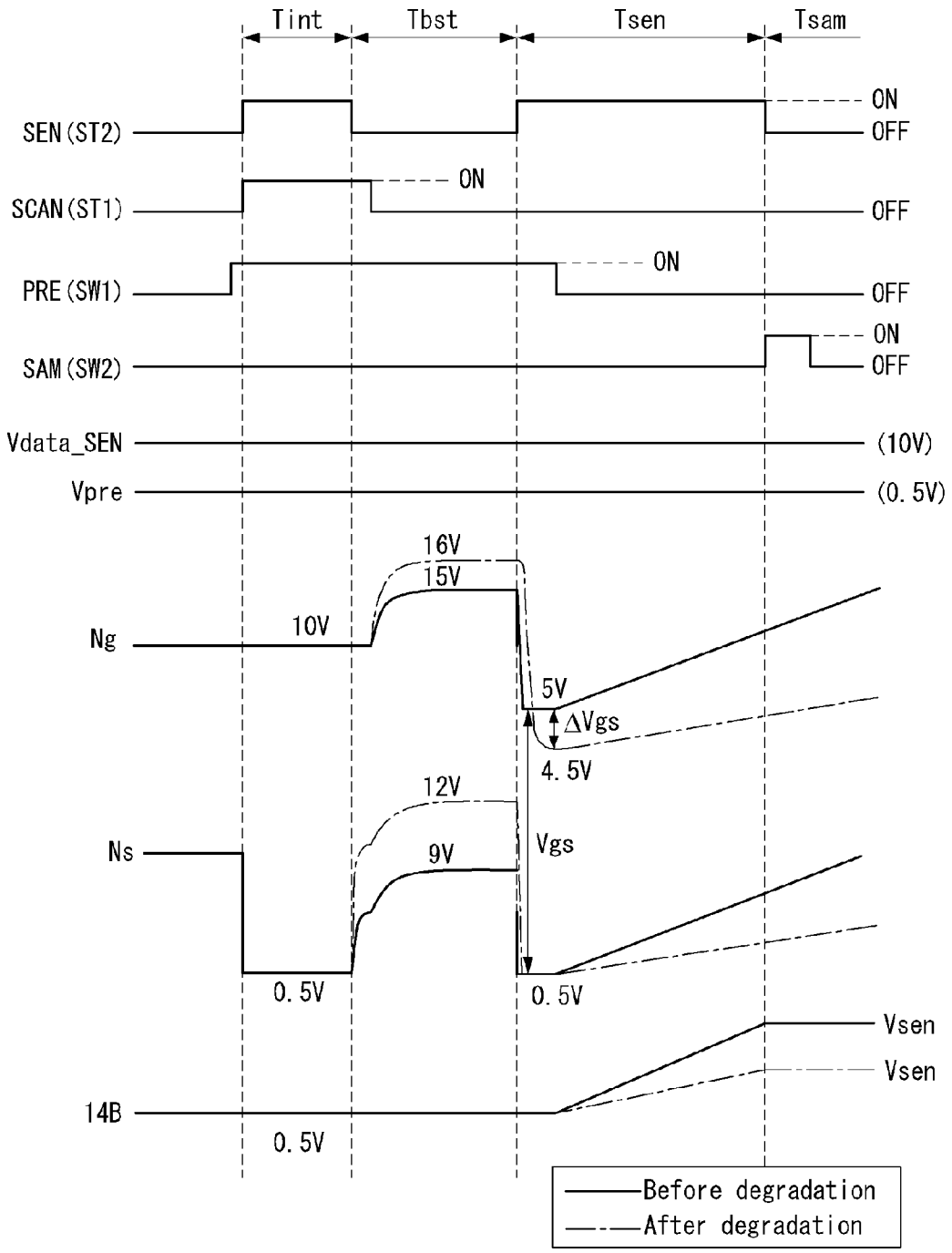
FIG. 7 shows a waveform of a control signal and a voltage change waveform in each period when the degradation sensing method shown in FIG. 6 is applied to the configuration shown in FIG. 5.

FIG. 7 shows a waveform of a control signal and a voltage change waveform in each period when the degradation sensing method shown in FIG. 6 is applied to the configuration shown in FIG. 5. FIGS. 8A to 8D show an operation of the subpixel and an operation of the sensing unit in an initialization period, a boosting period, a sensing period, and a sampling period of FIG. 7, respectively. In the embodiment disclosed herein, the sensing data voltage Vdata_SEN was set to 10V, and the initialization voltage Vpre was set to 0.5V. In the voltage change waveform shown in FIG. 7, the solid line indicates before the generation of degradation, and the alternate long and short dash line indicates after the generation of degradation.

As shown in FIG. 7 and FIGS. 8A to 8D, a degradation sensing process according to the embodiment of the invention may be performed through an initialization period Tint in which the initialization step S10 is performed, a boosting period Tbst in which the boosting step S20 is performed, a sensing period Tsen in which the sensing step S30 is performed, and a sampling period Tsam in which the sampling step S40 is performed.

Figure 8A:
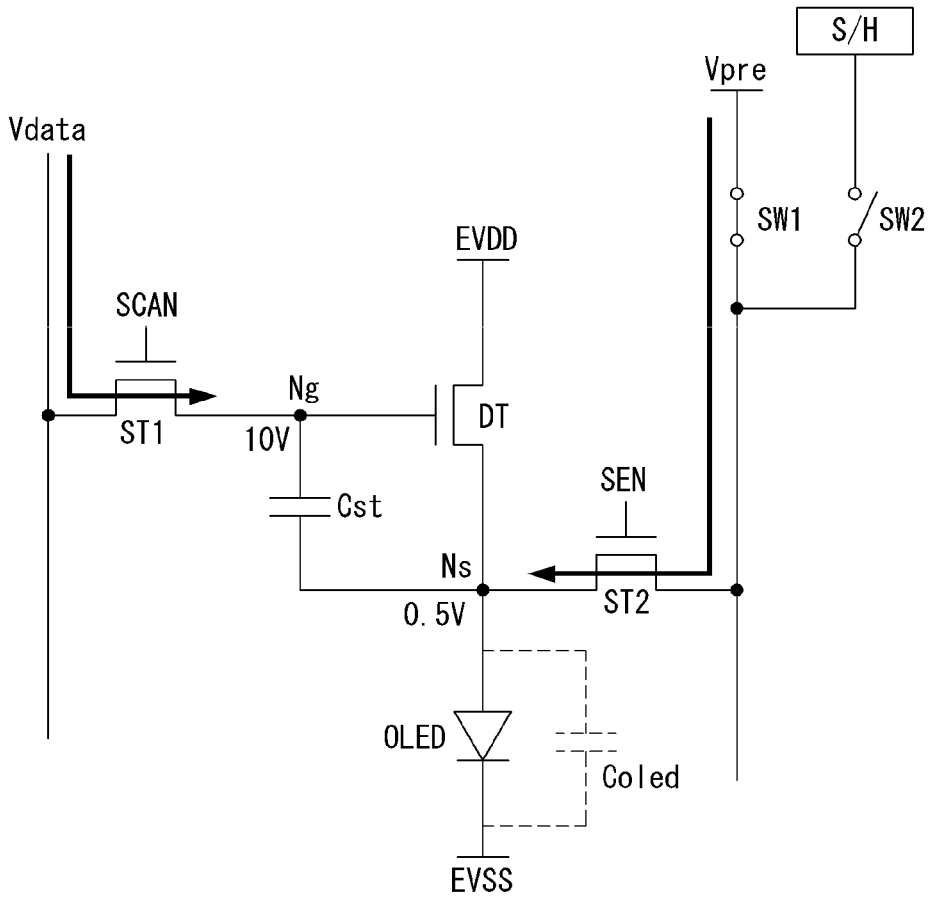
FIGS. 8A to 8D show an operation of a subpixel and an operation of a sensing unit in an initialization period, a boosting period, a sensing period, and a sampling period of FIG. 7, respectively.

In the initialization period Tint, the scan control signal SCAN, the sensing control signal SEN, and the initialization control signal PRE are applied at an on-level, and the sampling control signal SAM is applied at an off-level. As a result, as shown in FIG. 8A, the sensing data voltage Vdata_SEN is applied to the gate node Ng of the driving TFT DT, and the initialization voltage Vpre is applied to the source node Ns of the driving TFT DT.

Figure 8B:
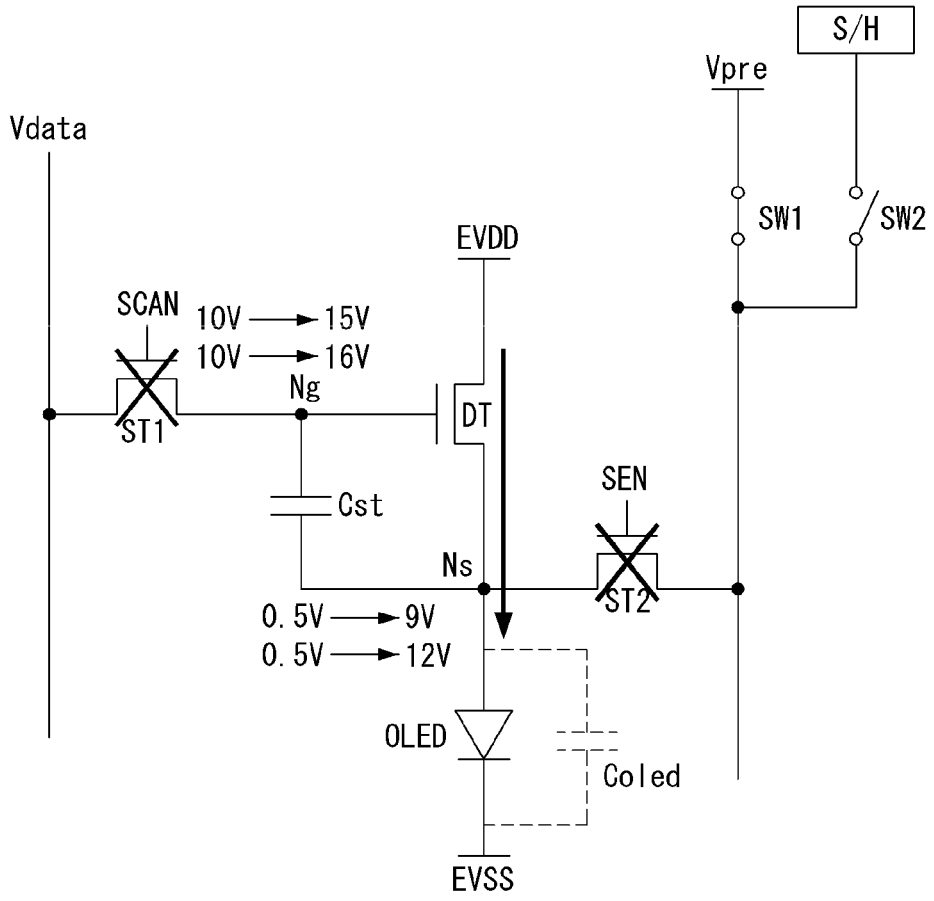

In the boosting period Tbst, only the initialization control signal PRE is applied at the on-level, and the scan control signal SCAN, the sensing control signal SEN, and the sampling control signal SAM are applied at the off-level. As a result, as shown in FIG. 8B, the gate node Ng and the source node Ns of the driving TFT DT are floated, and the drain-to-source current Ids of the driving TFT DT is applied to the organic element OLED. A voltage of the source node Ns is boosted by the drain-to-source current Ids of the driving TFT DT, and also a voltage of the gate node Ng electrically coupled with the source node Ns is boosted through the capacitor Cst. When the voltage of the source node Ns is greater than the operating point voltage of the organic element OLED, the organic element OLED is turned on. When the organic element OLED is turned on, the voltage of the source node Ns varies (from 9V to 12V, for example) depending on the degradation degree of the organic element OLED. Further, the voltage of the gate node Ng varies (from 15V to 16V, for example) depending on the degradation degree of the organic element OLED.

In the boosting period Tbst, the scan control signal SCAN and the sensing control signal SEN may be simultaneously applied at the off-level. However, as shown in FIG. 7, the scan control signal SCAN may applied at the off-level later than the sensing control signal SEN. In this instance, a portion of the degradation degree of the organic element OLED may be previously reflected in the source node Ns in an initial period of the boosting period Tbst.

Figure 8C:
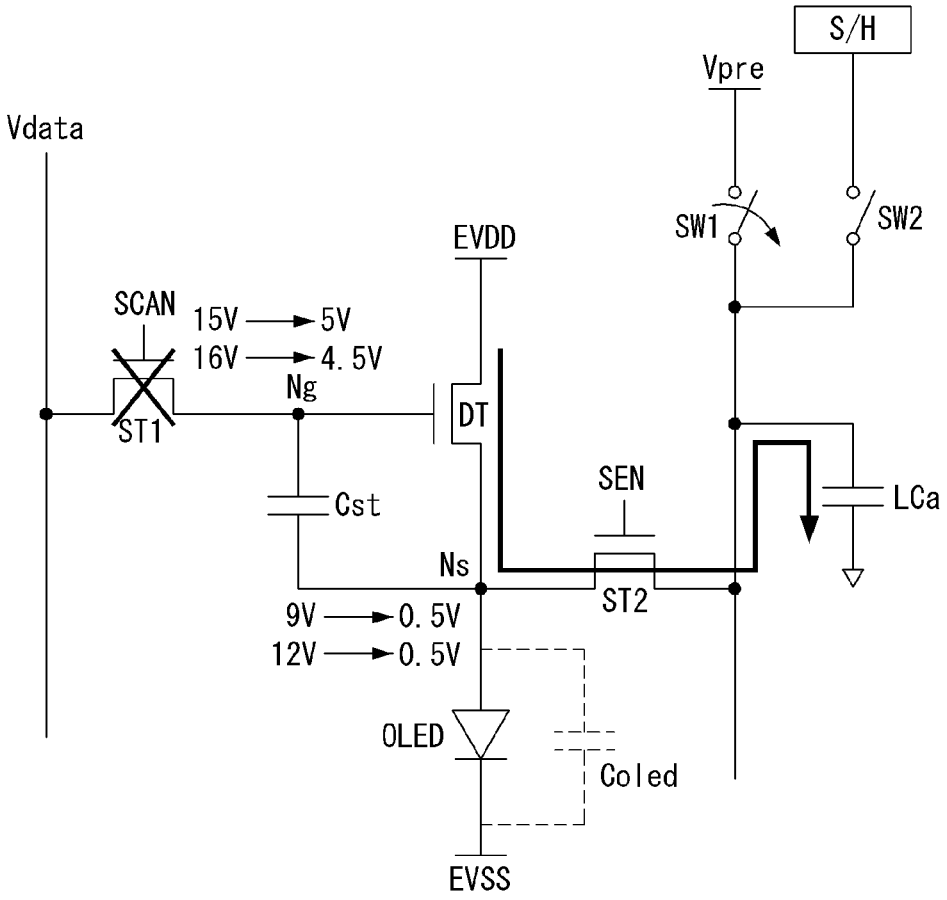

In the sensing period Tsen, the sensing control signal SEN is applied at the on-level, and the initialization control signal PRE is maintained at the on-level for a predetermined period of time and then is inverted to the off-level. Further, the scan control signal SCAN and the sampling control signal SAM are applied at the off-level. As a result, as shown in FIG. 8C, the gate-to-source voltage Vgs of the driving TFT DT is set such that it depends on the degradation degree of the organic element OLED and is indicative of and varies with the degradation degree of the organic OLED, and electrical charge for the drain-to-source current Ids of the driving TFT DT (which is determined by the set gate-to-source voltage Vgs) is stored in the line capacitor LCa of the sensing line 14B.

Because the source node Ns of the driving TFT DT again receives the initialization voltage Vpre and then is floated, the voltage of the source node Ns is reduced. In this instance, the voltage of the gate node Ng is also reduced because of a coupling influence of the storage capacitor Cst. A reduction in the voltage of the gate node Ng may vary depending on the degradation degree of the organic element OLED. In other words, the change in degradation of the organic element OLED is reflected by a voltage difference (=5V-4.5V, for example) of the gate node Ng before and after the degradation, and the voltage difference of the gate node Ng also results in a difference of the gate-to-source voltage Vgs of the driving TFT DT. Hence, a current flowing in the sensing line 14B varies depending on the degradation degree of the organic element OLED. The current is stored in the line capacitor LCa of the sensing line 14B. When the current flowing in the sensing line 14B decreases in proportion to the degradation degree of the organic element OLED, the voltage stored in the line capacitor LCa decreases. Generally speaking, lower degrees of OLED degradation cause an increase in current flowing in the sensing line 14B, and an increase in a charge slope of the charge stored in the line capacitor LCa. On the contrary, higher degrees of OLED degradation cause a decrease in current flowing in the sensing line 14B, and a decrease in the charge slope of the charge stored in the line capacitor LCa.

Figure 8D:
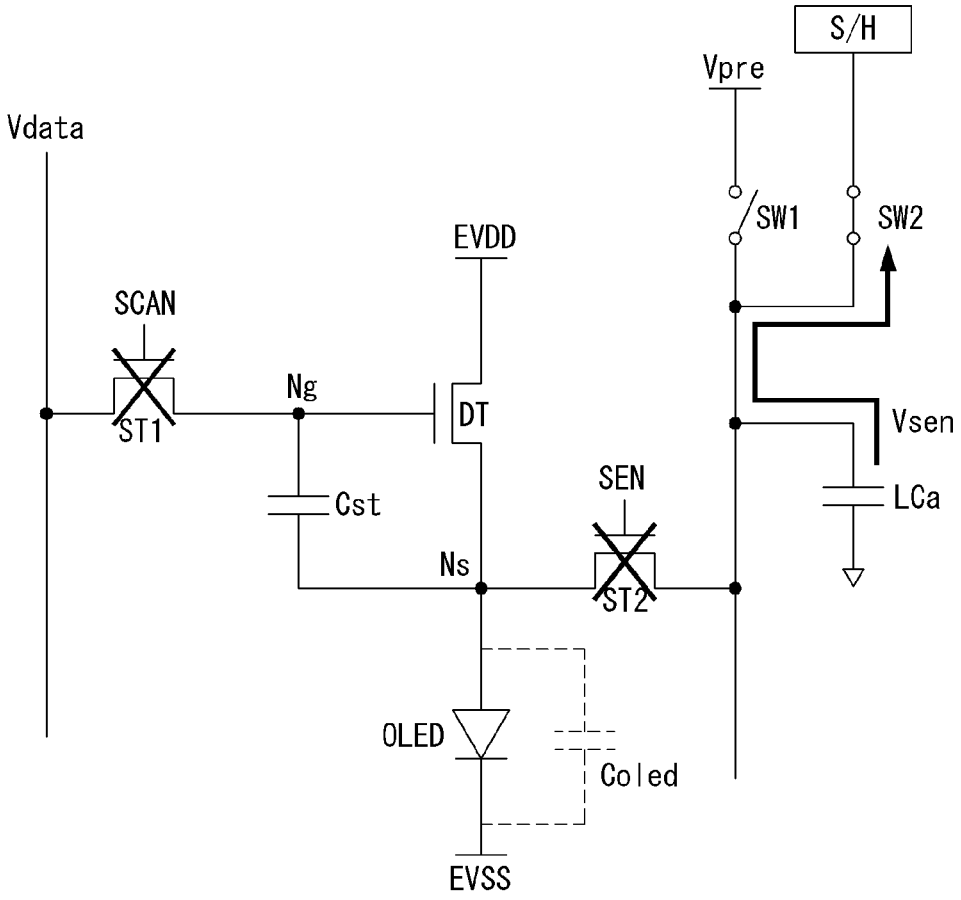

In the sampling period Tsam, only the sampling control signal SAM is applied at the on-level, and the scan control signal SCAN, the sensing control signal SEN, the initialization control signal PRE are applied at the off-level. As a result, as shown in FIG. 8D, the voltage stored in the line capacitor LCa is output as the sensing voltage Vsen.

Figure 9:
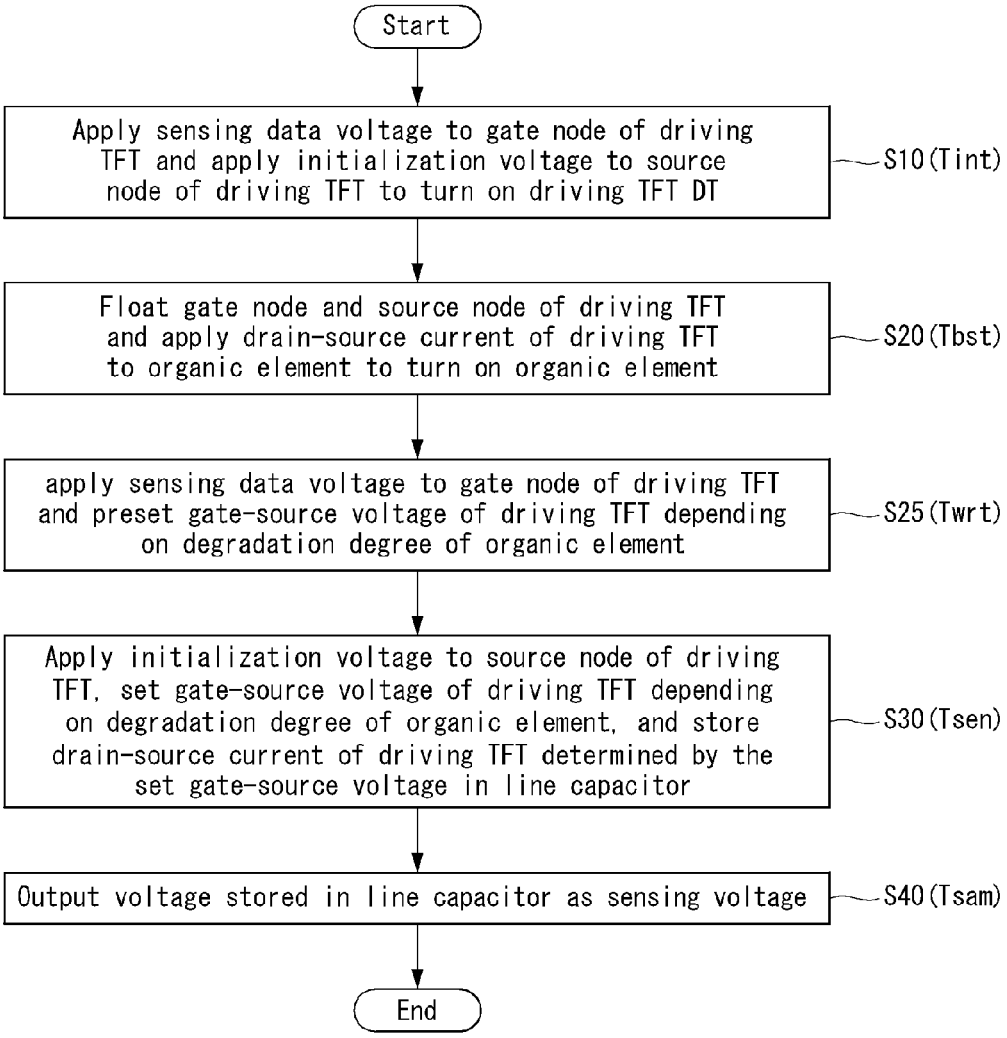
FIG. 9 shows another method for sensing degradation of an organic light emitting display according to an exemplary embodiment of the invention.

FIG. 9 shows another method for sensing the degradation of the organic light emitting display according to the embodiment of the invention.

As shown in FIG. 9, the degradation sensing method according to the embodiment of the invention includes an initialization step S10, a boosting step S20, a writing step S25, a sensing step S30, and a sampling step S40.

The degradation sensing method of FIG. 9 is different from the degradation sensing method of FIG. 6 in that it further includes the writing step S25. Since the initialization step S10, the boosting step S20, the sensing step S30, and the sampling step S40 of FIG. 9 are substantially the same as those of FIG. 6, a further description may be briefly made or may be entirely omitted.

In the writing step S25, the degradation sensing method according to the embodiment of the invention again applies the sensing data voltage Vdata_SEN to the gate node Ng of the driving TFT DT, which presets the gate-to-source voltage Vgs of the driving TFT DT depending on the degradation degree of the organic element OLED such that the gate-to-source voltage Vgs is indicative of the degradation degree of the OLED. In the writing step S25, the degradation degree of the organic element OLED is more easily converted into the gate-to-source voltage Vgs of the driving TFT DT by presetting the gate-to-source voltage Vgs of the driving TFT DT depending on the degradation degree of the organic element OLED before the sensing step S30 for setting the gate-to-source voltage Vgs of the driving TFT DT depending on the degradation degree of the organic element OLED. This results in an increase in the sensing accuracy when sensing the degradation of the organic element OLED.

Figure 10:
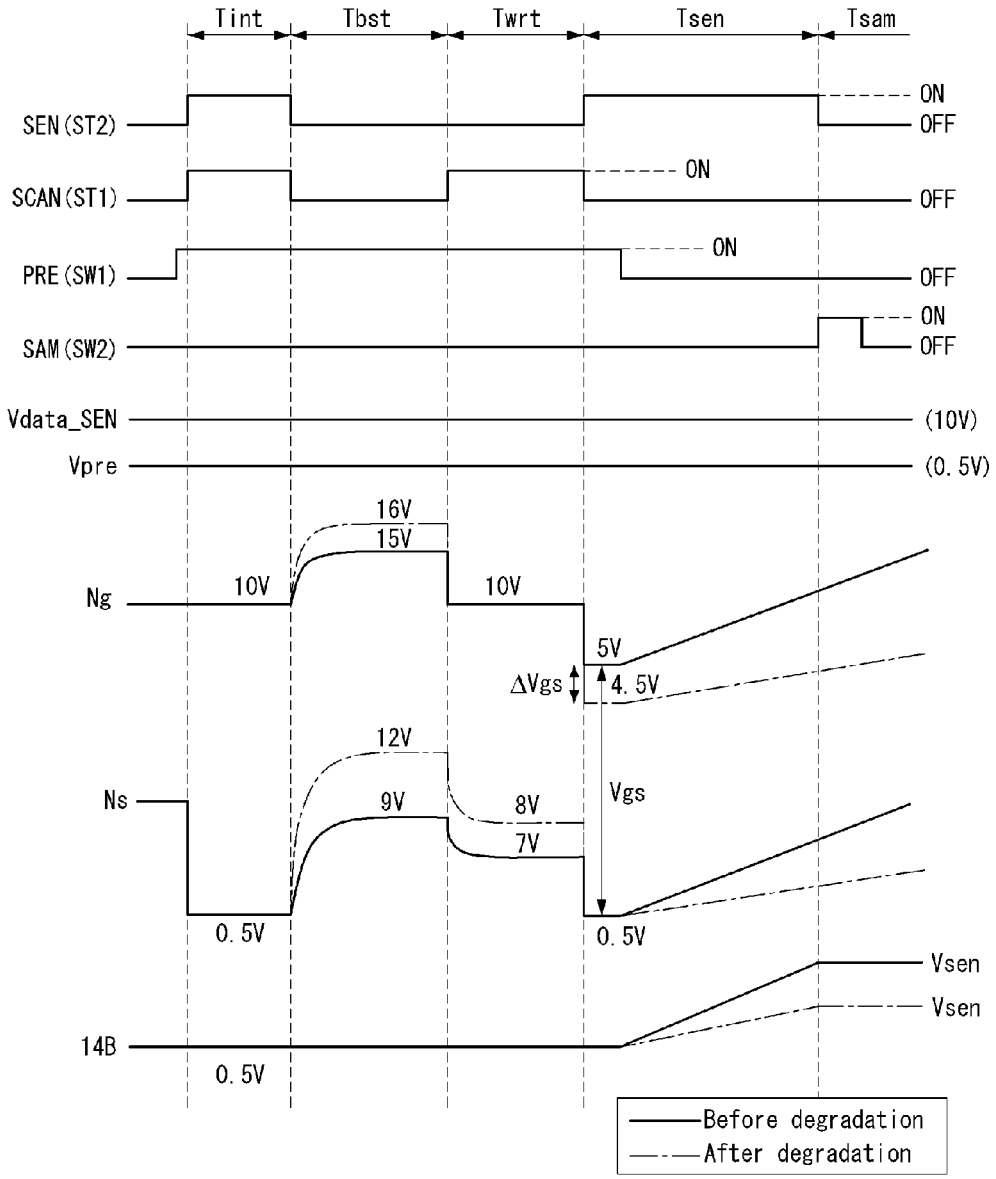
FIG. 10 shows a waveform of a control signal and a voltage change waveform in each period when the degradation sensing method shown in FIG. 9 is applied to the configuration shown in FIG. 5.

FIG. 10 shows a waveform of a control signal and a voltage change waveform in each period when the degradation sensing method shown in FIG. 9 is applied to the configuration shown in FIG. 5. FIGS. 11A to 11E show an operation of the subpixel and an operation of the sensing unit in an initialization period, a boosting period, a writing period, a sensing period, and a sampling period of FIG. 10, respectively. In the embodiment disclosed herein, the sensing data voltage Vdata_SEN was set to 10V, and the initialization voltage Vpre was set to 0.5V. In the voltage change waveform shown in FIG. 10, the solid line indicates before the generation of degradation, and the alternate long and short dash line indicates after the generation of degradation.

As shown in FIG. 10 and FIGS. 11A to 11E, a degradation sensing process according to the embodiment of the invention may be performed through an initialization period Tint in which the initialization step S10 is performed, a boosting period Tbst in which the boosting step S20 is performed, a writing period Twrt in which the writing step S25 is performed, a sensing period Tsen in which the sensing step S30 is performed, and a sampling period Tsam in which the sampling step S40 is performed.

Since the operation of the subpixel and the operation of the sensing unit in the initialization period Tint, the boosting period Tbst, the sensing period Tsen, and the sampling period Tsam are substantially the same as those of FIG. 7 and FIGS. 8A to 8D, a further description may be briefly made or may be entirely omitted.

Figure 11A:
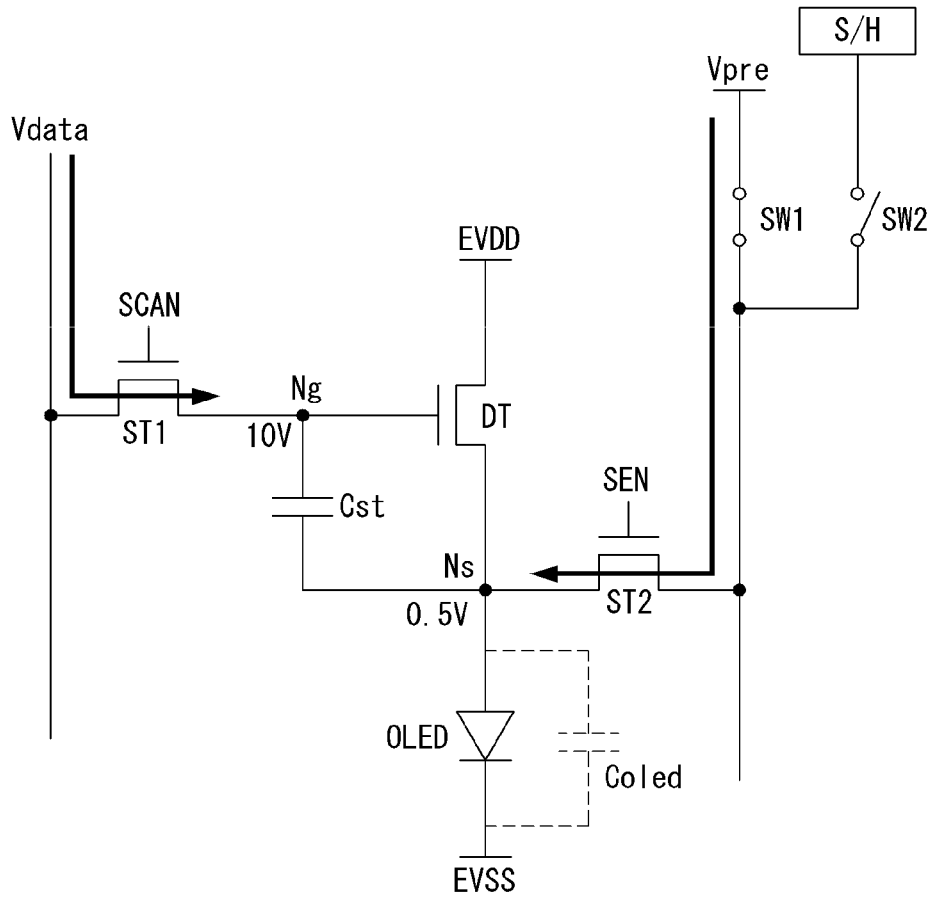
FIGS. 11A to 11E show an operation of a subpixel and an operation of a sensing unit in an initialization period, a boosting period, a writing period, a sensing period, and a sampling period of FIG. 10, respectively.
Figure 11B:
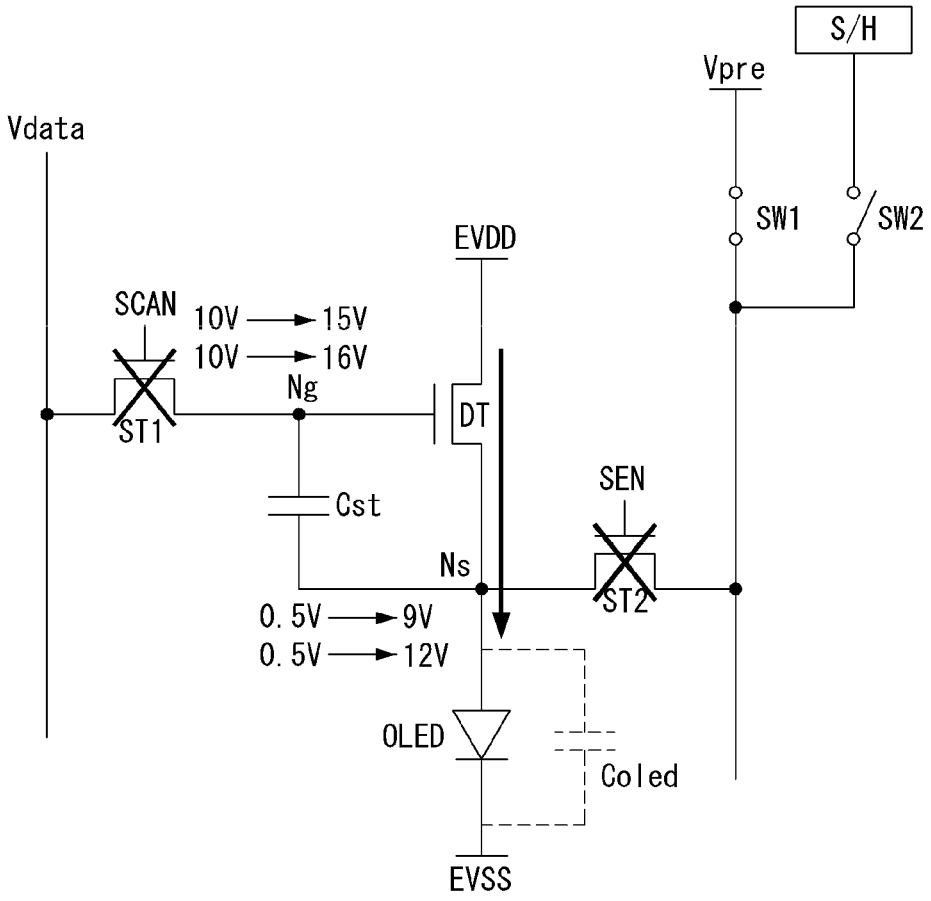
Figure 11C:
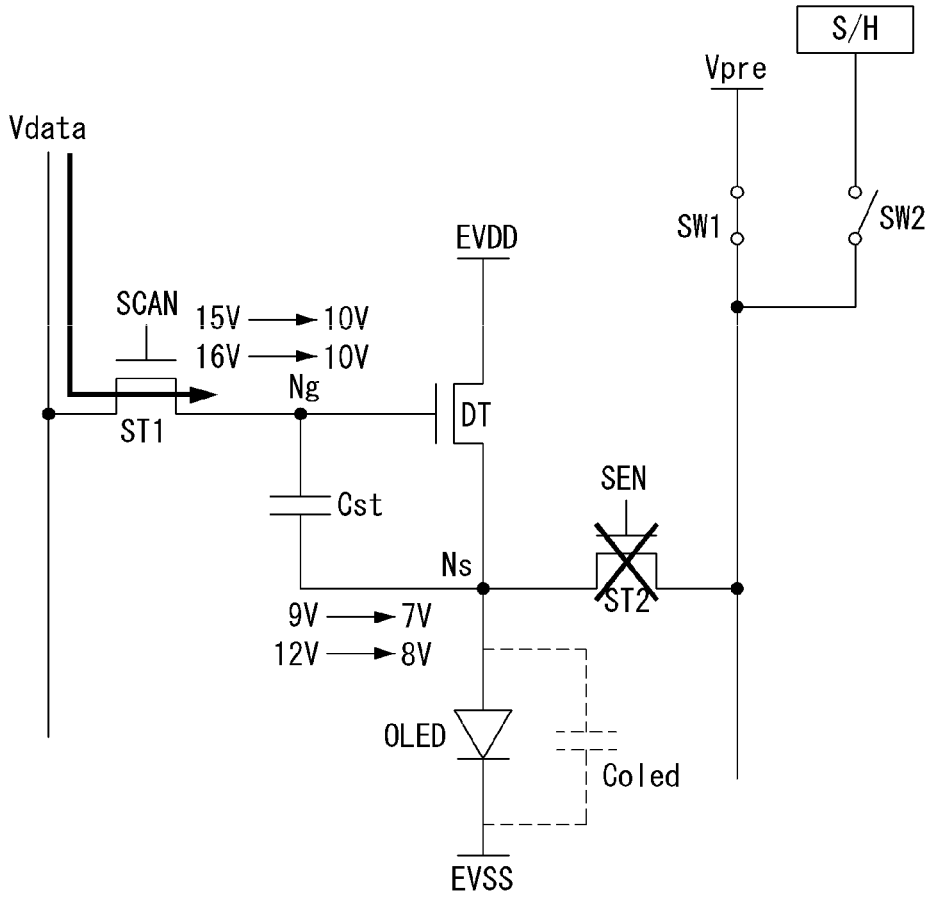
Figure 11D:
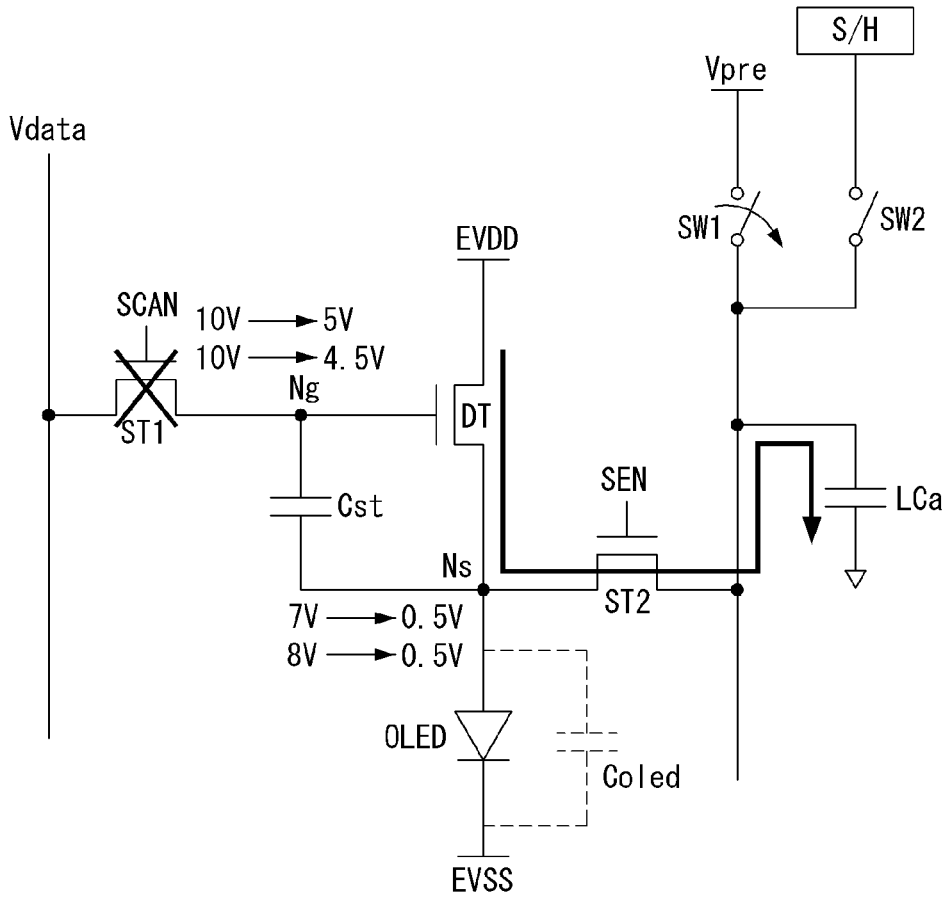
Figure 11E:
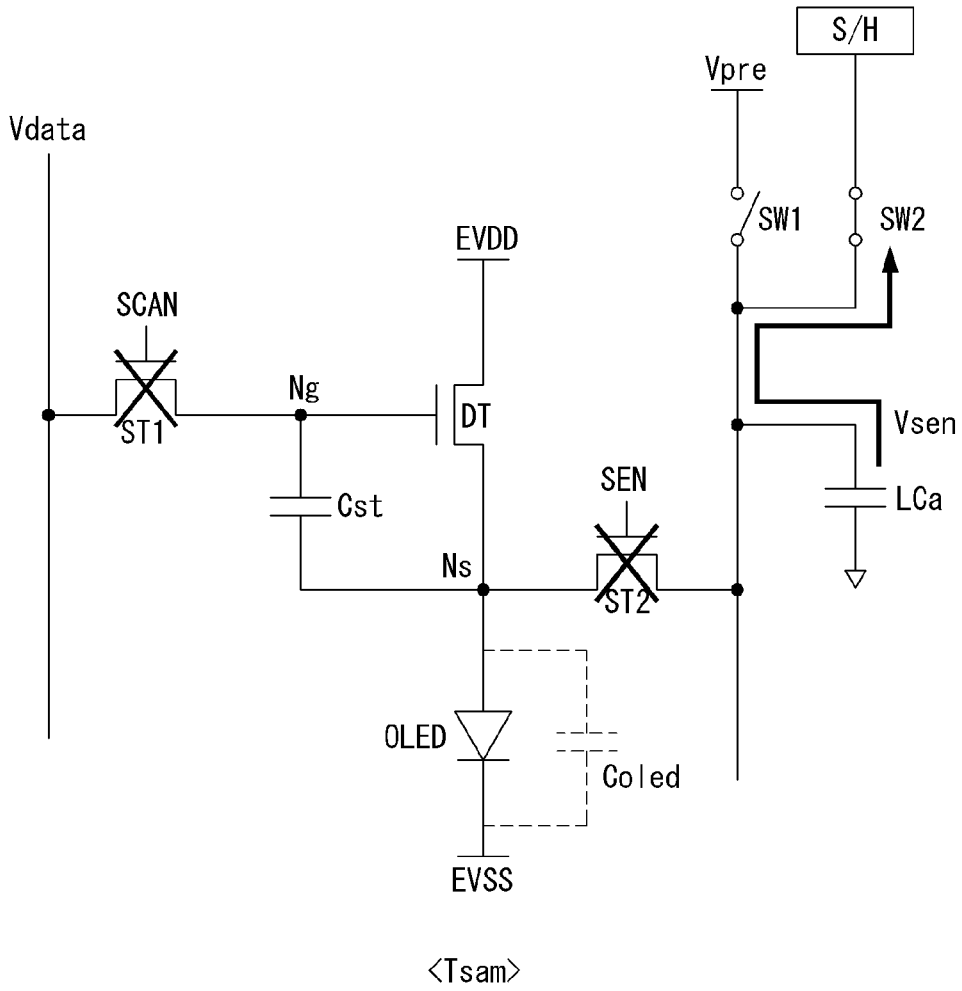

In the writing period Twrt, the scan control signal SCAN and the initialization control signal PRE are applied at the on-level, and the sensing control signal SEN and the sampling control signal SAM are applied at the off-level. As a result, as shown in FIG. 11C, the gate-to-source voltage Vgs of the driving TFT DT is preset depending on the degradation degree of the organic element OLED and is indicative of the degradation degree of the organic element OLED, and the drain-to-source current Ids of the driving TFT DT determined by the preset gate-to-source voltage Vgs is applied to the organic element OLED. In the writing period Twrt, because the gate node Ng of the driving TFT DT is reduced from a boosting level (of 15V and 16V, for example) to the sensing data voltage Vdata_SEN (of 10V, for example), the voltage of the source node Ns is reduced (to 7V and 8V, for example) because of the coupling influence of the storage capacitor Cst. In this instance, the voltage of the source node Ns becomes the operating point voltage of the organic element OLED and varies depending on the degradation degree of the organic element OLED.

Figure 12:
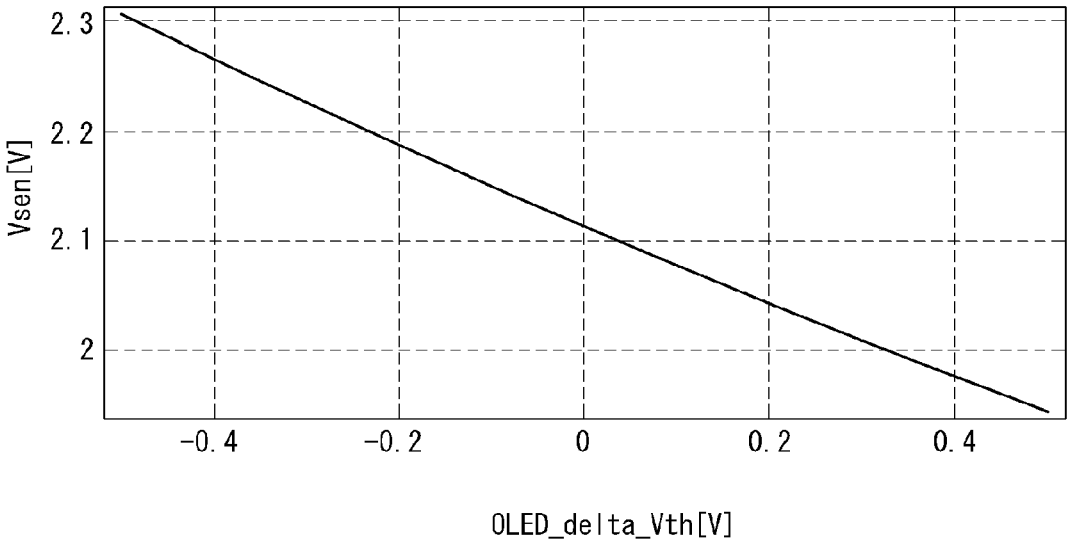
FIG. 12 is a graph showing a relationship between a degradation degree of an organic element and a sensing voltage.
Figure 13:
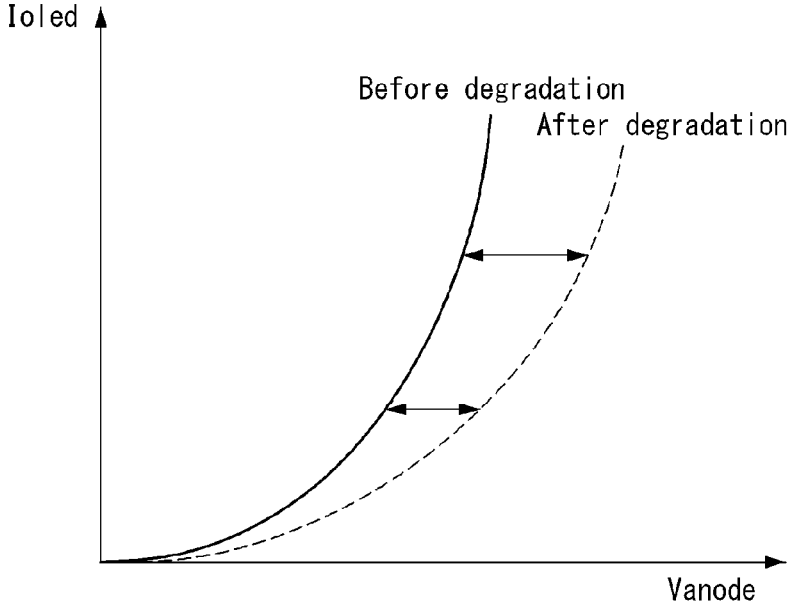
FIG. 13 is a graph showing a relationship between a degradation degree of an organic element and a driving current flowing in the organic element.
Figure 14:
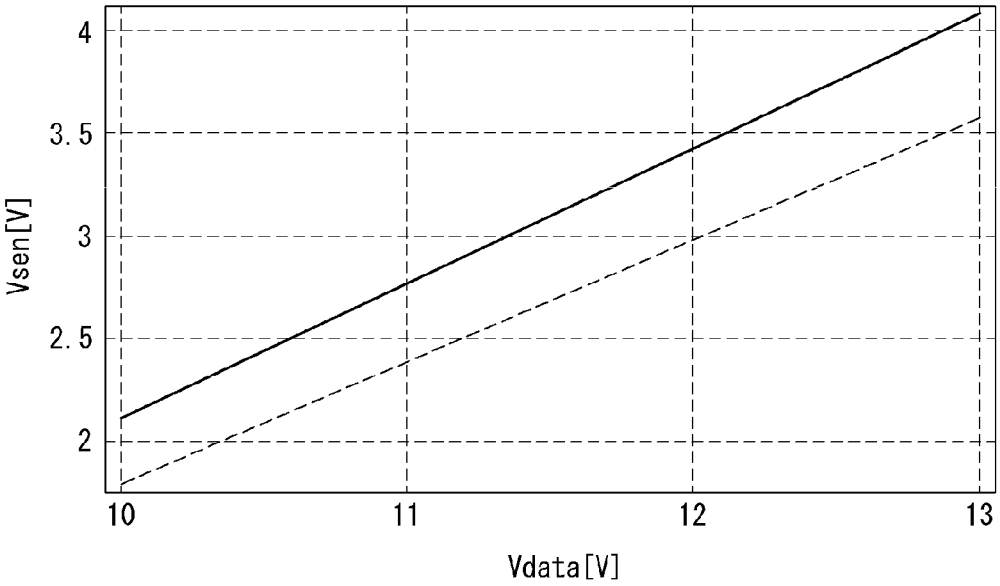
FIG. 14 is a graph showing a relationship between a sensing data voltage and a sensing voltage.

FIG. 12 is a graph showing a relationship between the degradation degree of the organic element and the sensing voltage. FIG. 13 is a graph showing a relationship between the degradation degree of the organic element and a driving current flowing in the organic element. FIG. 14 is a graph showing a relationship between the sensing data voltage and the sensing voltage.

As can be seen from FIG. 12, when the degradation of the organic element OLED is sensed using the degradation sensing method according to the embodiment of the invention, the sensing voltage Vsen output through the sensing unit decreases as the degradation degree of the organic element OLED increases (i.e., as an operating point voltage ΔVth of the organic element OLED increases). This indicates that the degradation of the organic element OLED results in changes in the gate-to-source voltage Vgs of the driving TFT DT, and the changes are sensed through the degradation sensing method according to the embodiment of the invention.

Because the degradation sensing method according to the embodiment of the invention adopts a voltage setting method (for changing the gate-to-source voltage Vgs of the driving TFT DT depending on the degradation degree of the organic element OLED), which is able to be more easily controlled than an existing current setting method, the sensing accuracy increases, and the circuit design area and the manufacturing cost are reduced by removing unnecessary current sources.

When the degradation of the organic element OLED is sensed using the degradation sensing method according to the embodiment of the invention, a degradation trend of the organic element OLED can be confirmed. Namely, as driving time passes, the degradation degree of the organic element OLED may be represented by the graph shown in FIG. 13. More specifically, when a driving current Ioled flows through the organic element OLED, anode voltages Vanode of the organic element OLED before and after the degradation are different from each other. Further, as shown in FIG. 14, when a difference between the sensing data voltage Vdata and the sensing voltage Vsen is detected as a value equal to or greater than two points by varying the sensing data voltage Vdata using the degradation sensing method according to the embodiment of the invention, the degradation tendency of the organic element OLED can be confirmed based on a slope and a voltage.

FIGS. 15 to 18 show modification examples of the scan control signal and the sensing control signal and a voltage change according to the modification examples. In FIGS. 15 to 18, "DTG" indicates a voltage of the gate node of the driving TFT, "DTS" indicates a voltage of the source node of the driving TFT, and "Ref" indicates a voltage of the sensing line.

FIGS. 7 and 10 show that the scan control signal SCAN of the on-level and the sensing control signal SEN of the on-level completely overlap each other during the initialization period Tint. However, the embodiment of the invention is not limited thereto and may be variously changed as shown in FIGS. 15 to 18.

Figure 15:
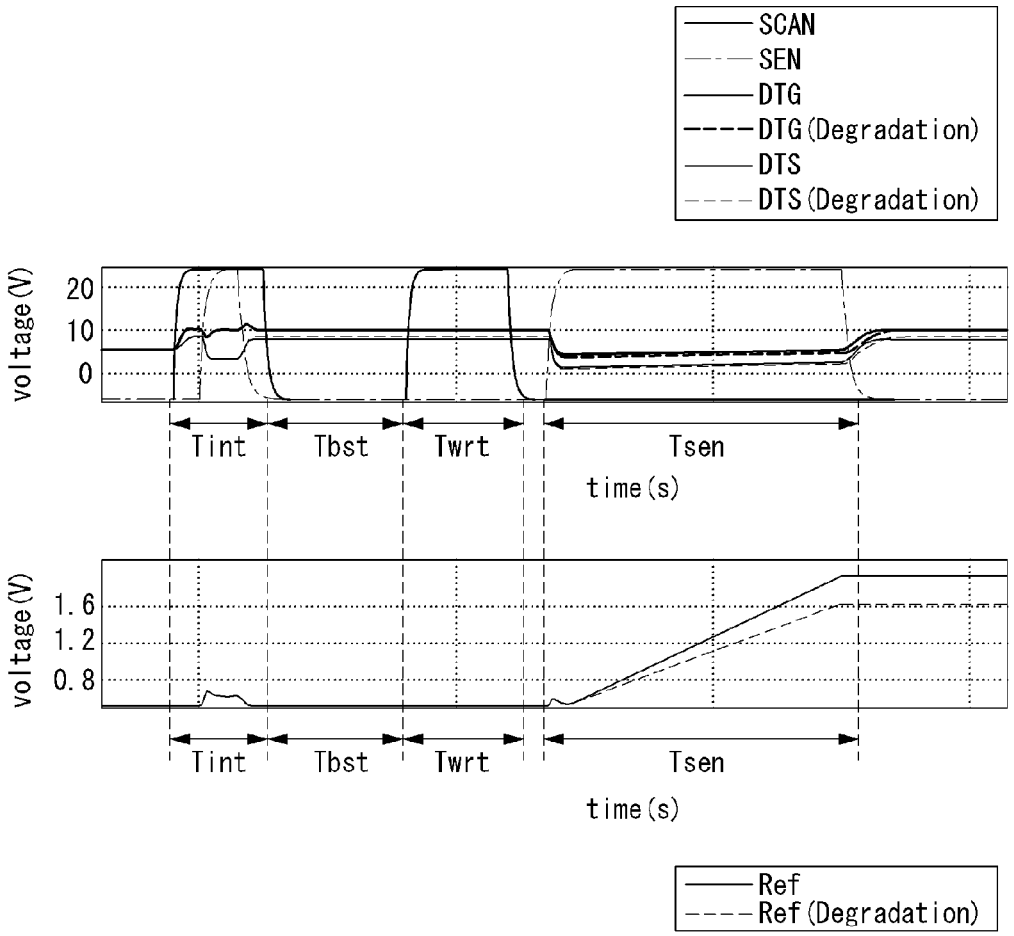
FIGS. 15 to 18 show modification examples of a scan control signal and a sensing control signal and a voltage change according to the modification examples.
Figure 16:
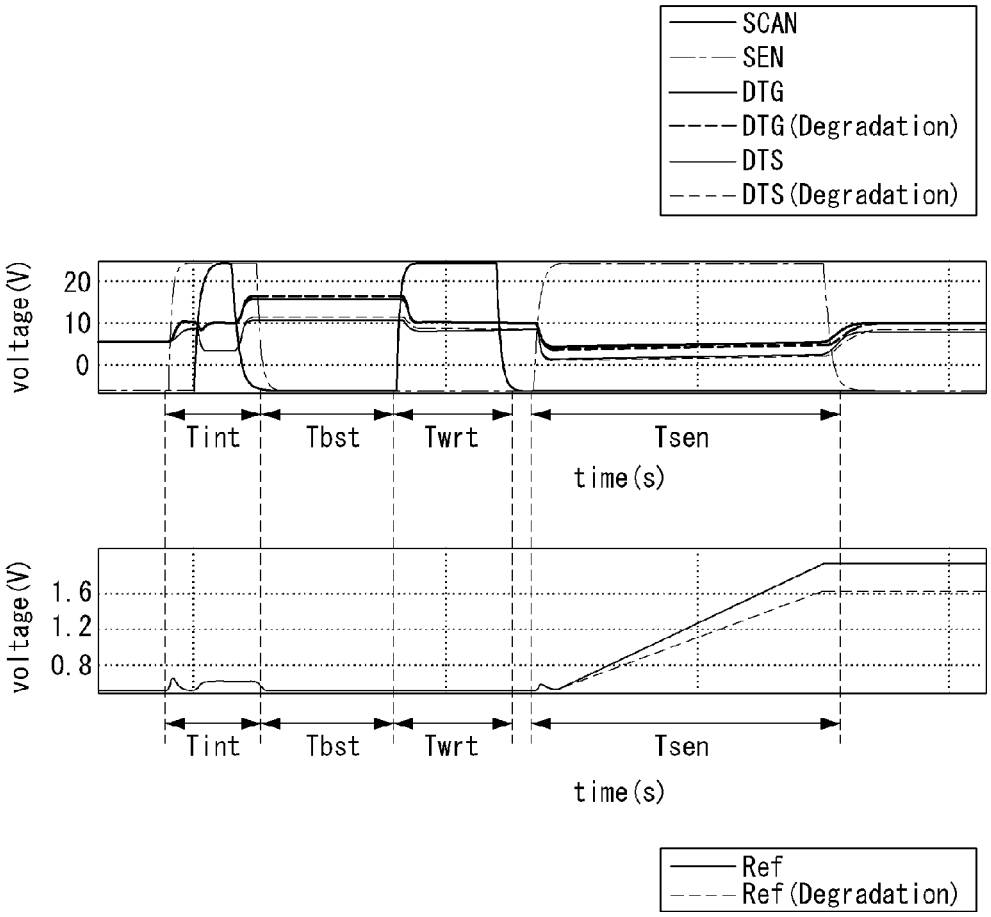
Figure 17:
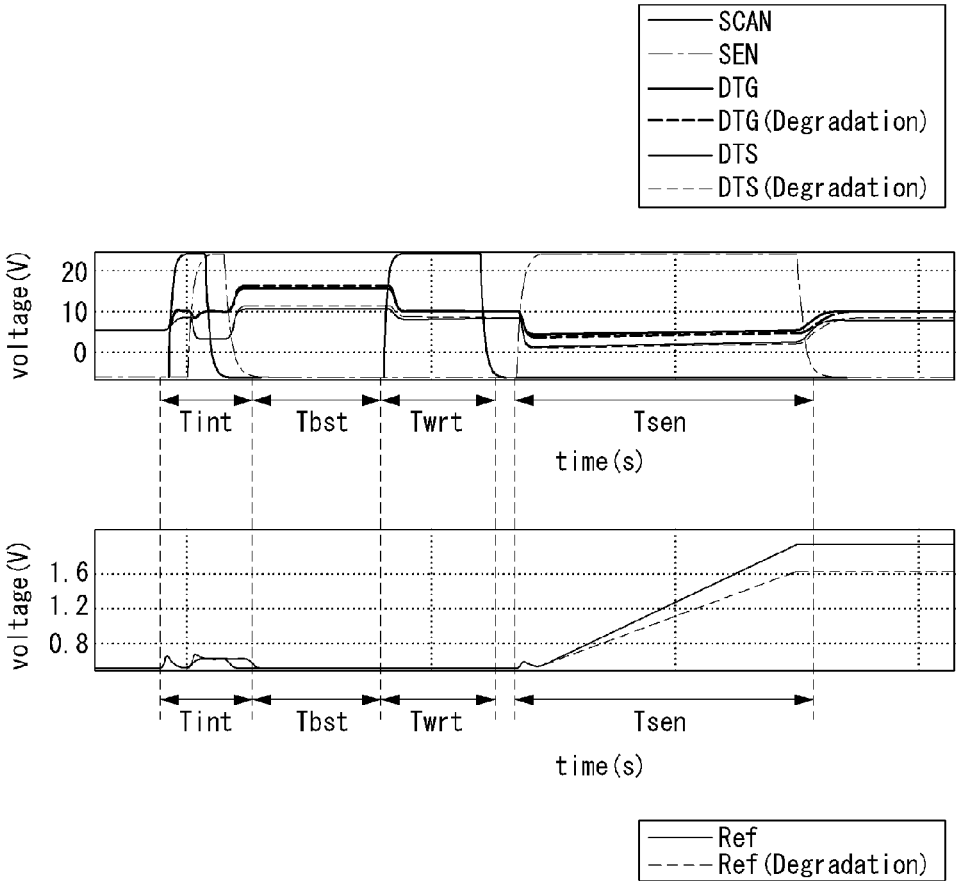
Figure 18:
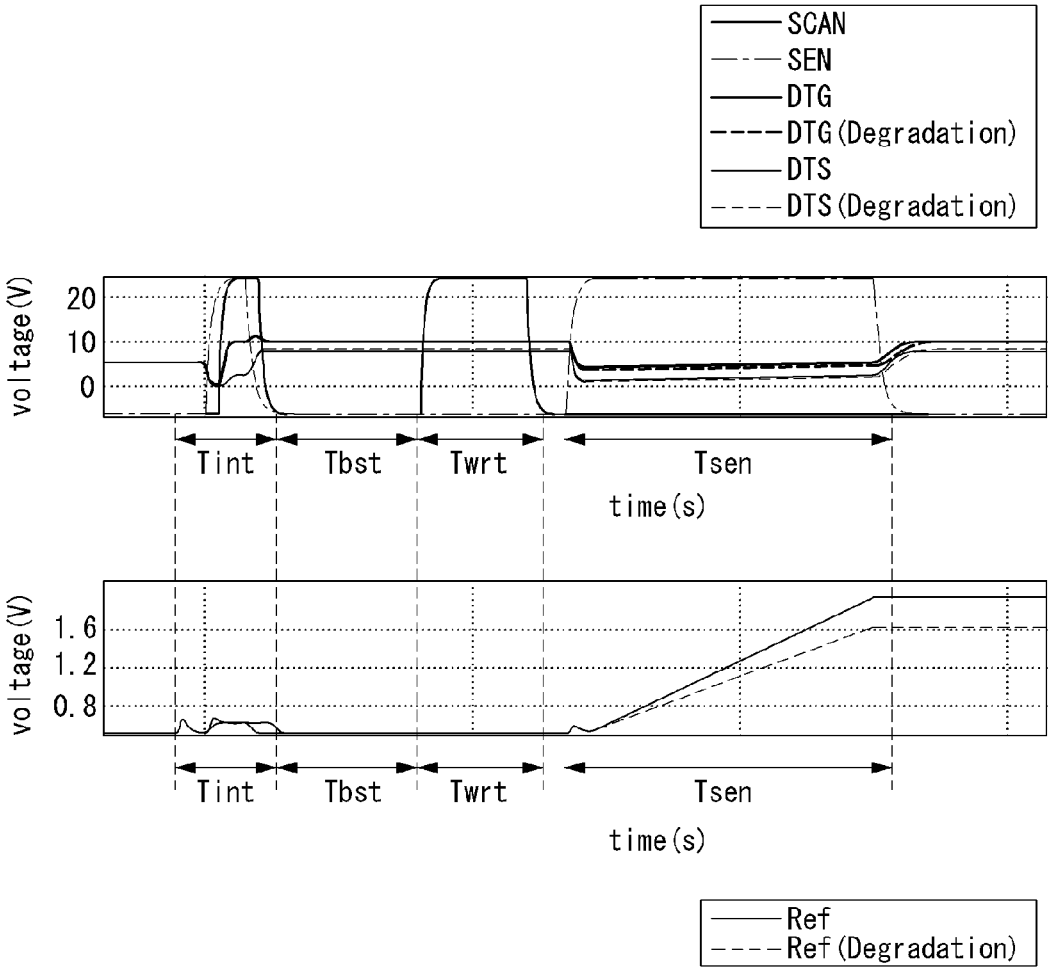

As shown in FIGS. 15 to 18, it may be designed so that at least a portion of the scan control signal SCAN of the on-level and at least a portion of the sensing control signal SEN of the on-level overlap each other during the initialization period Tint. More specifically, as shown in FIG. 15, the scan control signal SCAN having a pulse width wider than the sensing control signal SEN may be applied, so that the scan control signal SCAN completely covers the sensing control signal SEN during the initialization period Tint. Alternatively, as shown in FIG. 16, the sensing control signal SEN having a pulse width wider than the scan control signal SCAN may be applied, so that the sensing control signal SEN completely covers the scan control signal SCAN during the initialization period Tint. Alternatively, as shown in FIG. 17, the scan control signal SCAN may have the same pulse width as the sensing control signal SEN and may be applied earlier than the sensing control signal SEN during the initialization period Tint. Alternatively, as shown in FIG. 18, the sensing control signal SEN may have the same pulse width as the scan control signal SCAN and may be applied earlier than the scan control signal SCAN during the initialization period Tint.

As can be seen from the modification examples shown in FIGS. 15 to 18, the embodiment of the invention may easily secure a timing margin through the modified design of the scan control signal SCAN and the sensing control signal SEN. As can be seen from the simulation results of FIGS. 15 to 18, even if the scan control signal SCAN and the sensing control signal SEN are modified and designed, the desired operation effect related to the degradation sensing of the organic element OLED can be sufficiently obtained.

As described above, the degradation sensing method according to the embodiment of the invention changes the gate-to-source voltage of the driving TFT depending on the degradation degree of the organic element and detects changes in the current obtained based on changes in the gate-to-source voltage of the driving TFT as the sensing voltage. Because the degradation sensing method according to the embodiment of the invention adopts the voltage setting method, which is able to be more easily controlled than the existing current setting method, sensing accuracy increases, and the circuit design area and the manufacturing cost are reduced by removing the unnecessary current sources.

Furthermore, because the degradation sensing method according to the embodiment of the invention adopts the voltage setting method, the subpixels can be individually controlled and the degradation of an organic element of a desired subpixel can be accurately sensed even if the sensing line sharing structure is applied. The shared sensing line structure is also advantageous in increasing the aperture ratio of the display panel.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for sensing degradation of an organic light emitting display including a plurality of subpixels each including an organic element and a driving thin film transistor (TFT) controlling an emission amount of the organic element and a sensing unit connected to at least one of the plurality of subpixels through a sensing line, the method comprising:

during an initialization period, applying a sensing data voltage to a gate node of the driving TFT and applying an initialization voltage to a source node of the driving TFT to turn on the driving TFT;

during a boosting period, floating the gate node and the source node of the driving TFT and applying a drain-to-source current of the driving TFT to the organic element to turn on the organic element;

during a sensing period, again applying the initialization voltage to the source node of the driving TFT, a gate-to-source voltage of the driving TFT set to be indicative of a degradation degree of the organic element as a result of again applying the initialization voltage, and charging a line capacitor of the sensing line with the drain-to-source current of the driving TFT that is controlled by the set gate-to-source voltage; and during a sampling period, outputting a voltage of the line capacitor as a sensing voltage.

2. The method of claim 1, further comprising during a writing period between the boosting period and the sensing period again applying the sensing data voltage to the gate node of the driving TFT, the again applying of the sensing data voltage presetting the gate-to-source voltage of the driving TFT to be indicative of the degradation degree of the organic element.

3. The method of claim 2, wherein when subpixels constituting the same unit pixel among the plurality of subpixels share one sensing line with one another, the sensing data voltage applied during the initialization period is applied only to the gate node of the driving TFT of a sensing target subpixel of the subpixels constituting the same unit pixel, and during the initialization period, applying a black level display data voltage less than the sensing data voltage to the gates nodes of the driving TFTs of remaining subpixels from the subpixels, wherein the initialization voltage is set to be less than a turn-on voltage of the organic element, and a difference between the black level display data voltage and the initialization voltage is set to be less than a threshold voltage of the driving TFT.

4. The method of claim 2, wherein each subpixel further includes:

a first switch TFT which is turned on in response to a scan control signal and connects a data line, to which the sensing data voltage is applied, to the gate node of the driving TFT;

a second switch TFT which is turned on in response to a sensing control signal and connects the sensing line, to which the initialization voltage is applied, to the source node of the driving TFT; and a storage capacitor connected between the gate node and the source node of the driving TFT, wherein the sensing unit includes an initialization switch, which is turned on in response to an initialization control signal and connects an input terminal of the initialization voltage to the sensing line, and a sampling switch, which is turned on in response to a sampling control signal and connects the sensing line to a sample and hold unit, and wherein the method further comprises:

applying the scan control signal at an on-level only in the initialization period and the writing period, applying the sensing control signal at an on-level only in the initialization period and the sensing period, applying the initialization control signal at an on-level in the initialization period, the boosting period, and the writing period and then inverting the initialization control signal to an off-level in the sensing period, and applying the sampling control signal at an on-level only in the sampling.

5. The method of claim 4, wherein at least a portion of the scan control signal of the on-level and at least a portion of the sensing control signal of the on-level overlap each other during the initialization period.

6. The method of claim 1, wherein each subpixel further includes:

a first switch TFT which is turned on in response to a scan control signal and connects a data line, to which the sensing data voltage is applied, to the gate node of the driving TFT;

a second switch TFT which is turned on in response to a sensing control signal and connects the sensing line, to which the initialization voltage is applied, to the source node of the driving TFT; and a storage capacitor connected between the gate node and the source node of the driving TFT, wherein the sensing unit includes an initialization switch, which is turned on in response to an initialization control signal and connects an input terminal of the initialization voltage to the sensing line, and a sampling switch, which is turned on in response to a sampling control signal and connects the sensing line to a sample and hold unit, and wherein the method further comprises:

applying the scan control signal at an on-level only in the initialization period, applying the sensing control signal at an on-level only in the initialization period and the sensing period, applying the initialization control signal at an on-level in the initialization period and the boosting period, and then inverting the initialization control signal to an off-level in the sensing period, and applying the sampling control signal at an on-level only in the sampling period.

7. The method of claim 6, wherein at least a portion of the scan control signal of the on-level and at least a portion of the sensing control signal of the on-level overlap each other during the initialization period.

8. The method of claim 1, wherein the sensing data voltage applied to each subpixel is set differently depending on an amount of a threshold voltage deviation and an amount of a mobility deviation of the driving TFT included in the corresponding subpixel.

9. A method of operation in an organic light emitting display comprising a subpixel including an organic element and a driving thin film transistor (TFT) controlling current through the organic element, the method comprising:

applying a sensing data voltage to a gate node of the driving TFT and applying an initialization voltage to a source node of the driving TFT to turn on the driving TFT;

after applying the sensing data voltage and initialization voltage, floating the gate node and the source node of the driving TFT, a source voltage at the source node increasing to at least a turn-on voltage of the organic element while the gate node and the source node are floated; and after floating the gate node and the source node of the driving TFT, again applying the initialization voltage to the source node of the driving TFT while the gate node is floated, the gate-to-source voltage set to be indicative of a degradation degree of the organic element as a result of again applying the initialization voltage to the source node of the driving TFT.

10. The method of claim 9, wherein the organic light emitting display includes a sensing unit connected to the subpixel through a sensing line, and the method further comprises:

after again applying the initialization voltage to the source node, charging a line capacitor of the sensing line with a drain-to-source current of the driving TFT that is controlled by the set gate-to-source voltage; and after charging the line capacitor, outputting a sensing voltage based on charge stored in the line capacitor.

11. The method of claim 9, further comprising:

after floating the gate node and the source node of the driving TFT and before again applying the initialization voltage to the source node of the driving TFT, again applying the sensing data voltage to the gate node of the driving TFT, the again applying of the sensing data voltage presetting the gate-to-source voltage of the driving TFT to be indicative of the degradation degree of the organic element.

12. The method of claim 9, wherein applying the initialization voltage comprises applying an initialization voltage having a voltage level that is less than the turn-on voltage of the organic element.

13. The method of claim 9, the organic light emitting display further comprising a storage capacitor connected between the gate node and the source node of the driving TFT, and wherein a gate voltage at the gate node increases while the source voltage at the source node increases to at least the turn-on voltage due to capacitive coupling through the storage capacitor.

14. The method of claim 9, the organic light emitting display further comprising another subpixel in a same unit pixel as the subpixel, the subpixel and the another subpixel sharing one sensing line, and further comprising:

applying a black level display data voltage less than the sensing data voltage to a gate node of a driving TFT of the another subpixel while applying the sensing data voltage to the gate node of the subpixel.

15. A organic light emitting display, comprising:

a subpixel including an organic element and a driving thin film transistor (TFT) controlling current through the organic element;

circuitry coupled to the sub-pixel to:

apply a sensing data voltage to a gate node of the driving TFT and apply an initialization voltage to a source node of the driving TFT to turn on the driving TFT;

after applying the sensing data voltage and initialization voltage, float the gate node and the source node of the driving TFT, a source voltage at the source node increasing to at least a turn-on voltage of the organic element while the gate node and the source node are floated; and after floating the gate node and the source node of the driving TFT, again apply the initialization voltage to the source node of the driving TFT while the gate node is floated, the gate-to-source voltage set to be indicative of a degradation degree of the organic element as a result of again applying the initialization voltage to the source node of the driving TFT.

16. The organic light emitting display of claim 15, the circuitry comprising a sensing unit connected to the subpixel through a sensing line, the circuitry to:

after again applying the initialization voltage to the source node of the driving TFT, charge a line capacitor of the sensing line with a drain-to-source current of the driving TFT that is controlled by the set gate-to-source voltage; and after charging the line capacitor, output a sensing voltage based on charge stored in the line capacitor.

17. The organic light emitting display of claim 15, wherein the circuitry is further to:

after floating the gate node and the source node of the driving TFT and before again applying the initialization voltage to the source node of the driving TFT, again apply the sensing data voltage to the gate node of the driving TFT, the gate-to-source voltage of the driving TFT preset to be indicative of the degradation degree of the organic element as a result of the again applying of the sensing data voltage.

18. The organic light emitting display of claim 15, wherein the initialization voltage has a voltage level that is less than the turn-on voltage of the organic element.

19. The organic light emitting display of claim 15, further comprising a storage capacitor connected between the gate node and the source node of the driving TFT, and wherein a gate voltage at the gate node increases while the source voltage at the source node increases to at least the turn-on voltage due to capacitive coupling through the storage capacitor.

20. The organic light emitting display of claim 15, further comprising:

another subpixel in a same unit pixel as the subpixel, the subpixel and the another subpixel sharing one sensing line, and wherein the circuitry applies a black level display data voltage less than the sensing data voltage to a gate node of a driving TFT of the another subpixel while applying the sensing data voltage to the gate node of the subpixel.

* * * * *